US007783244B2

(12) United States Patent
Nagasawa et al.

(10) Patent No.: US 7,783,244 B2
(45) Date of Patent: Aug. 24, 2010

(54) PAPER-SHEET PUNCHING DEVICE, PAPER-SHEET FOLDING DEVICE, AND IMAGE FORMING DEVICE

(75) Inventors: Minoru Nagasawa, Saitama (JP); Yusuke Harasawa, Saitama (JP); Shinjirou Hata, Saitama (JP)

(73) Assignee: Ricoh Company, Limited, Tokyo (JP)

( * ) Notice: Subject to any disclaimer, the term of this patent is extended or adjusted under 35 U.S.C. 154(b) by 396 days.

(21) Appl. No.: 11/497,363

(22) Filed: Aug. 2, 2006

(65) Prior Publication Data

US 2007/0029719 A1 Feb. 8, 2007

(30) Foreign Application Priority Data

Aug. 2, 2005 (JP) ..... 2005-223684

(51) Int. Cl.
*G03G 15/00* (2006.01)

(52) U.S. Cl. ..... 399/407; 399/397

(58) Field of Classification Search ..... 399/393, 399/397, 407

See application file for complete search history.

(56) References Cited

U.S. PATENT DOCUMENTS 5,253,030 A * 10/1993 Shigemura et al. ..... 399/407
2003/0047858 A1 3/2003 Tsuchiya et al.
2003/0227121 A1* 12/2003 Yamakawa et al. ..... 270/37

FOREIGN PATENT DOCUMENTS

| | | | |
|---|---|---|---|
| EP | 1 650 145 | | 4/2006 |
| JP | 59223646 | | 12/1984 |
| JP | 62-32798 | | 2/1987 |
| JP | 64-31169 | | 2/1989 |
| JP | 8-324874 | | 12/1996 |
| JP | 11-208971 | * | 8/1999 |
| JP | 2003-212424 | | 7/2003 |
| JP | 2004083212 | | 3/2004 |
| JP | 2004-217348 | | 8/2004 |

OTHER PUBLICATIONS

Search Report for corresponding European Application No. 06253996.0-2302 dated Jan. 5, 2007.
Extended European Search Report dated Apr. 24, 2007 for corresponding European Application No. 06253996.0.

* cited by examiner

*Primary Examiner*—Ren Yan
*Assistant Examiner*—Andy L Pham
(74) *Attorney, Agent, or Firm*—Harness, Dickey & Pierce, P.L.C.

(57) ABSTRACT

A paper-sheet punching device punches a hole in a paper sheet. The paper sheet punching device includes a punching unit that receives a paper sheet via an inlet, and punches a hole in the paper sheet; and a return roller that delivers the paper sheet with the hole via an outlet.

2 Claims, 19 Drawing Sheets

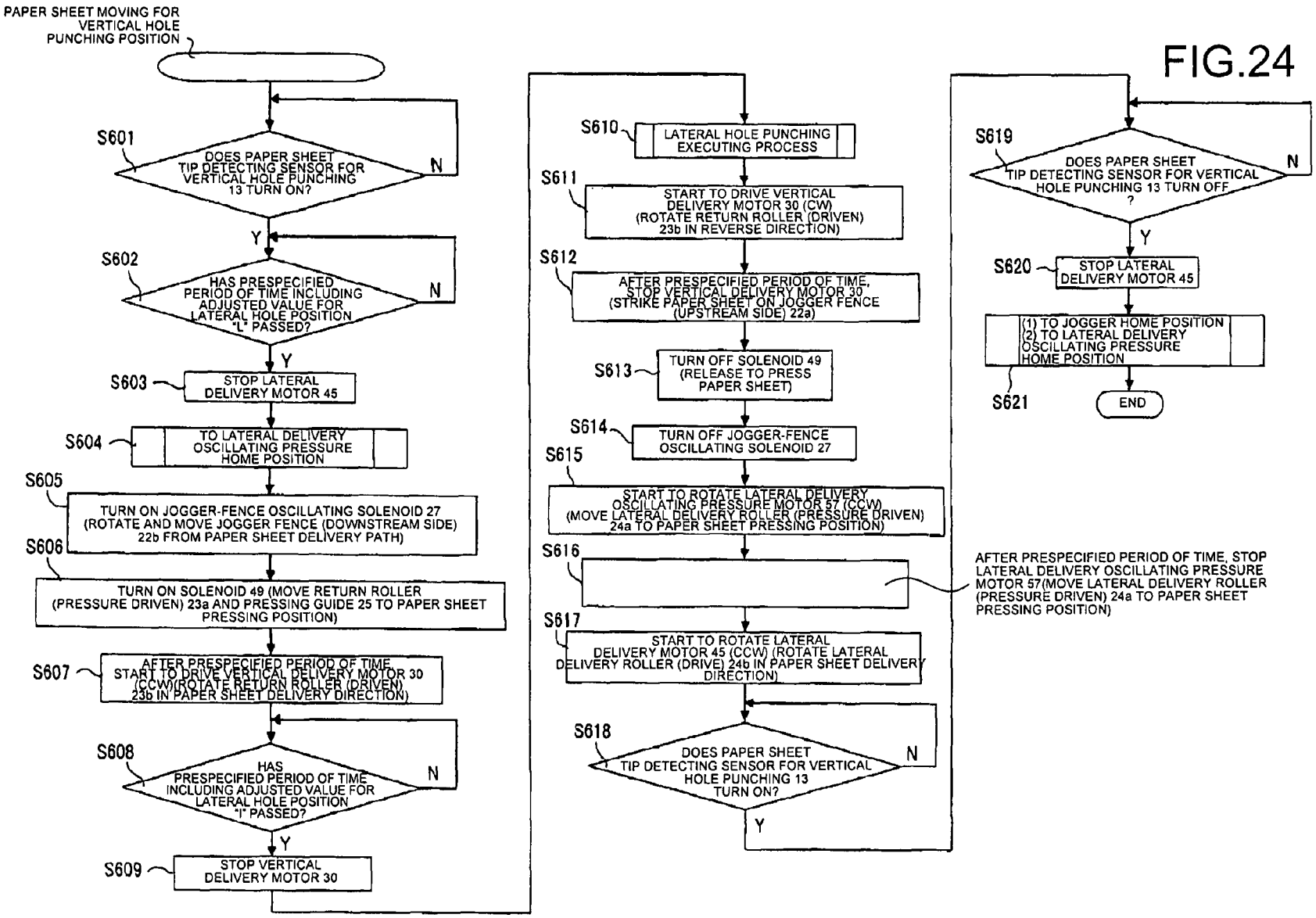
FIG.24
PAPER SHEET MOVING FOR VERTICAL HOLE PUNCHING POSITION
S601
DOES PAPER SHEET TIP DETECTING SENSOR FOR VERTICAL HOLE PUNCHING 13 TURN ON?
N
Y
S602
HAS PRESPECIFIED PERIOD OF TIME INCLUDING ADJUSTED VALUE FOR LATERAL HOLE POSITION "L" PASSED?
N
Y
S603
STOP LATERAL DELIVERY MOTOR 45
S604
TO LATERAL DELIVERY OSCILLATING PRESSURE HOME POSITION
S605
TURN ON JOGGER-FENCE OSCILLATING SOLENOID 27 (ROTATE AND MOVE JOGGER FENCE (DOWNSTREAM SIDE) 22b FROM PAPER SHEET DELIVERY PATH)
S606
TURN ON SOLENOID 49 (MOVE RETURN ROLLER (PRESSURE DRIVEN) 23a AND PRESSING GUIDE 25 TO PAPER SHEET PRESSING POSITION)
S607
START TO DRIVE VERTICAL DELIVERY MOTOR 30 (CCW) (ROTATE RETURN ROLLER (DRIVEN) 23b IN PAPER SHEET DELIVERY DIRECTION)
AFTER PRESPECIFIED PERIOD OF TIME
S608
HAS PRESPECIFIED PERIOD OF TIME INCLUDING ADJUSTED VALUE FOR LATERAL HOLE POSITION "T" PASSED?
N
Y
S609
STOP VERTICAL DELIVERY MOTOR 30
S610
LATERAL HOLE PUNCHING EXECUTING PROCESS
S611
START TO DRIVE VERTICAL DELIVERY MOTOR 30 (CW) (ROTATE RETURN ROLLER (DRIVEN) 23b IN REVERSE DIRECTION)
S612
AFTER PRESPECIFIED PERIOD OF TIME, STOP VERTICAL DELIVERY MOTOR 30 (STRIKE PAPER SHEET ON JOGGER FENCE (UPSTREAM SIDE) 22a)
S613
TURN OFF SOLENOID 49 (RELEASE TO PRESS PAPER SHEET)
S614
TURN OFF JOGGER-FENCE OSCILLATING SOLENOID 27
S615
START TO ROTATE LATERAL DELIVERY OSCILLATING PRESSURE MOTOR 57 (CCW) (MOVE LATERAL DELIVERY ROLLER (PRESSURE DRIVEN) 24a TO PAPER SHEET PRESSING POSITION)
S616
AFTER PRESPECIFIED PERIOD OF TIME, STOP LATERAL DELIVERY OSCILLATING PRESSURE MOTOR 57(MOVE LATERAL DELIVERY ROLLER (PRESSURE DRIVEN) 24a TO PAPER SHEET PRESSING POSITION)
S617
START TO ROTATE LATERAL DELIVERY MOTOR 45 (CCW) (ROTATE LATERAL DELIVERY ROLLER (DRIVE) 24b IN PAPER SHEET DELIVERY DIRECTION)
S618
DOES PAPER SHEET TIP DETECTING SENSOR FOR VERTICAL HOLE PUNCHING 13 TURN ON?
N
Y
S619
DOES PAPER SHEET TIP DETECTING SENSOR FOR VERTICAL HOLE PUNCHING 13 TURN OFF ?
N
Y
S620
STOP LATERAL DELIVERY MOTOR 45
S621
(1) TO JOGGER HOME POSITION
(2) TO LATERAL DELIVERY OSCILLATING PRESSURE HOME POSITION
END

PAPER-SHEET PUNCHING DEVICE, PAPER-SHEET FOLDING DEVICE, AND IMAGE FORMING DEVICE

CROSS-REFERENCE TO RELATED APPLICATIONS

The present document incorporates by reference the entire contents of Japanese priority document, 2005-223684 filed in Japan on Aug. 2, 2005.

BACKGROUND OF THE INVENTION

1. Field of the Invention

The present invention relates to a paper-sheet punching device that punches a hole in a paper sheet.

2. Description of the Related Art

Japanese Patent Laid-Open Publication No. S62-32798 discloses a conventional punching device that punches holes in a copy paper-sheet, which is a copy of an original paper-sheet, after the copy paper-sheet is discharged from a copying machine. The punching device includes a positioning plate for positioning the copy paper-sheet, a punch that punches holes in the copy paper-sheet, a die provided at a position opposite to the punch so as to sandwich the paper sheet in association with the punch, and a paper sheet pressing plate that presses the copy paper-sheet while the punch punches holes in the copy paper-sheet so that the copy paper-sheet does not move. The copy paper-sheet with the holes passes through a nip between the punch and the die and is conveyed downstream.

In the conventional punching device, thus, it is necessary to secure a nip having a sufficient width between the punch and the die in consideration of the thickness of the paper sheet so that a stroke of the punch becomes longer. A longer stroke has a greater chance of punching irregular holes than a shorter stroke.

SUMMARY OF THE INVENTION

It is an object of the present invention to at least partially solve the problems in the conventional technology.

According to an aspect of the present invention, a paper-sheet punching device punches a hole in a paper sheet and includes a punching unit that receives a paper sheet from a first arrangement via an inlet, and punches a hole in the paper sheet; and a switchback delivery unit that delivers the paper sheet with the hole to a second arrangement via an outlet.

According to another aspect of the present invention, a paper-sheet folding device that folds a paper sheet includes the above paper sheet punching device.

According to still another aspect of the present invention, an image forming device that forms an image on a paper sheet based on an electrostatic latent image read from an original includes the above paper sheet punching device.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 24 is a flowchart for explaining the movement of a paper sheet for the position of a lateral hole punching position;

DETAILED DESCRIPTION OF THE PREFERRED EMBODIMENTS

Exemplary embodiments according to the present invention are described below with reference to the accompanying drawings.

Figure 27:
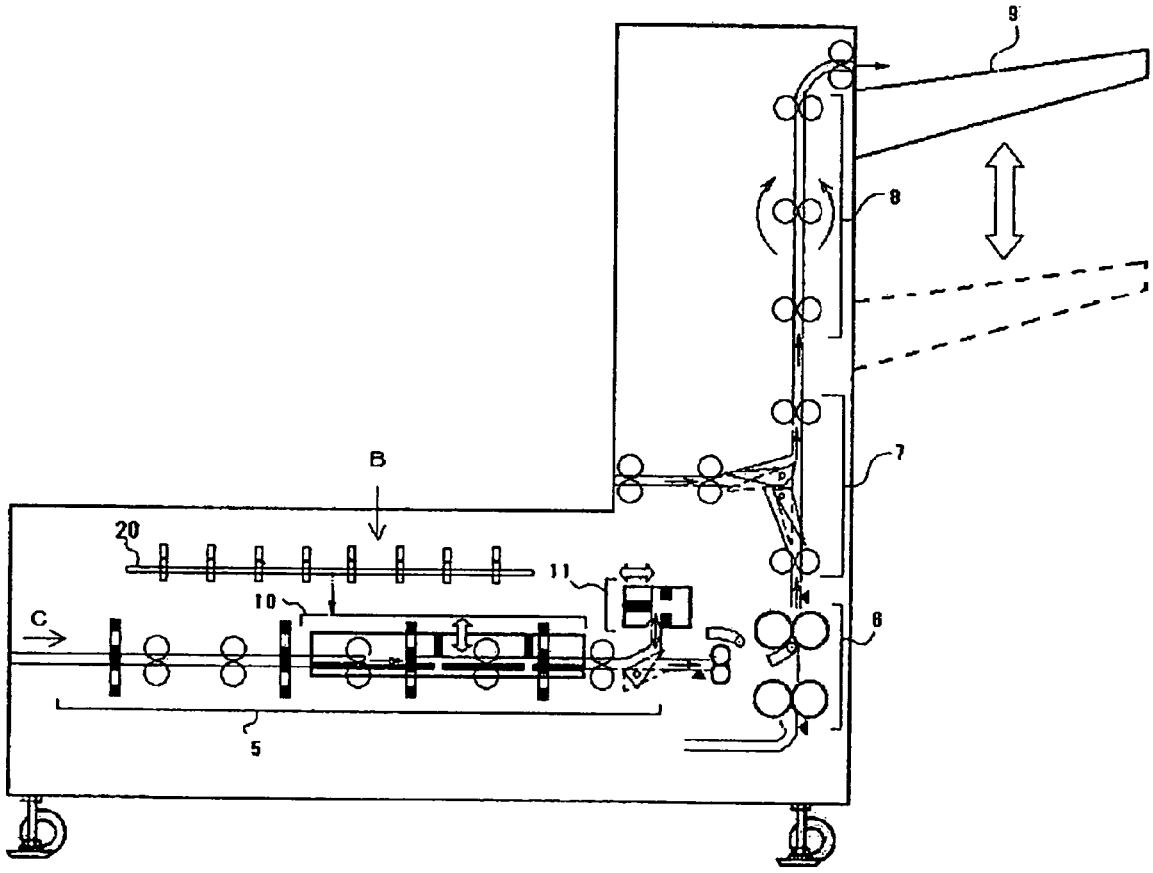
FIG. 27 is a side view of the paper sheet folding device according to the embodiments.
Figure 28:
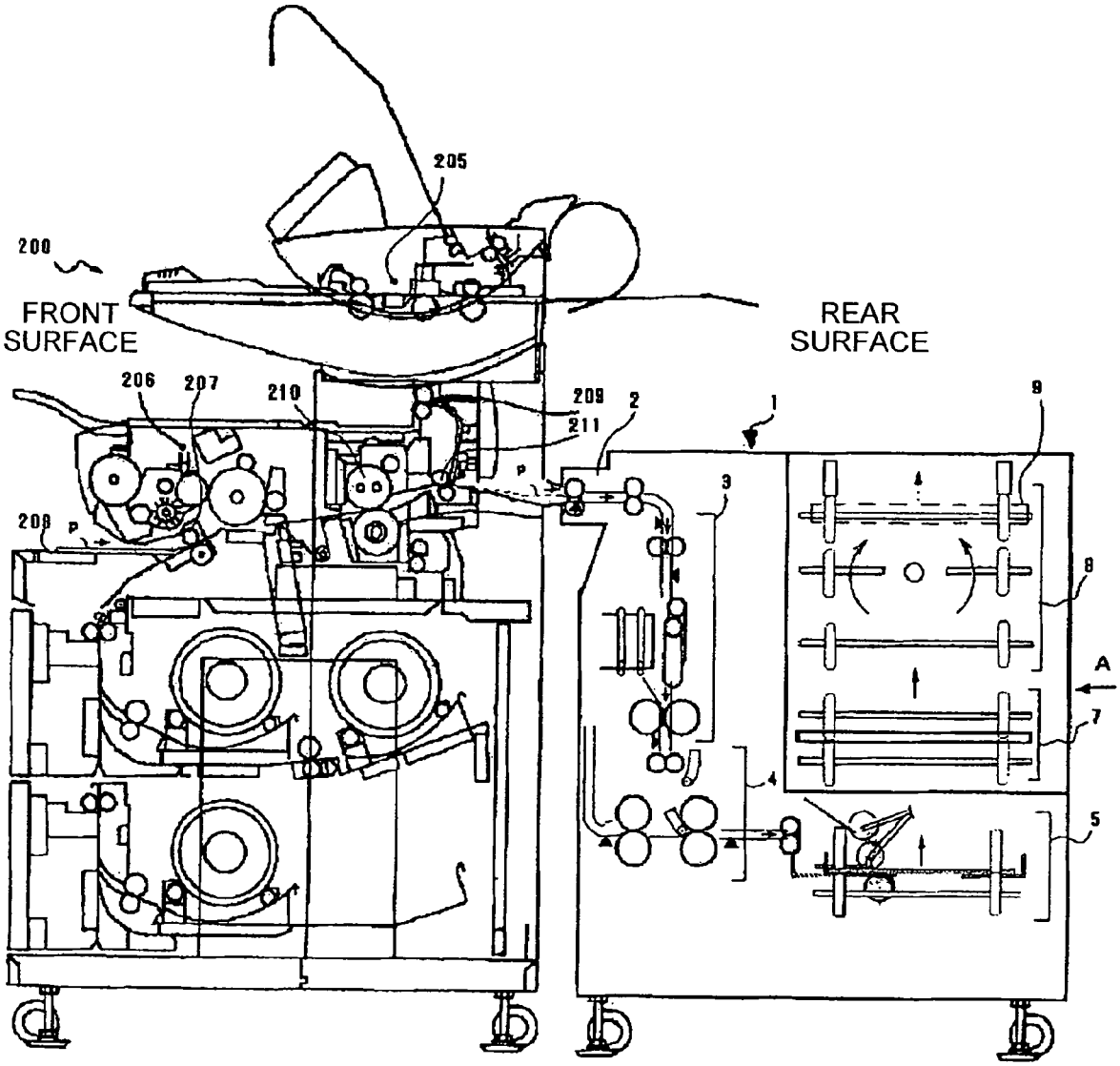
FIG. 28 is a side view of a copying machine with the paper sheet folding device.

FIGS. 27 and 28 are side views of a copying machine (an image forming device) according to an embodiment of the present invention. The copying machine includes a main body 200. Reference numeral 1 denotes a paper sheet folding device connected to the rear surface of the main body 200. The paper sheet folding device 1 comprises a connecting section 2 for connecting the paper sheet folding device 1 to the main body 200; an edge-face folding section 3 that folds the edge face of a paper sheet tip; an accordion-folding section 4 that accordion-folds a paper sheet in the delivery direction; a delivery switching section 5 that switches the accordion-folded paper sheet in the delivery direction; a cross-folding section 6 that cross-folds the switched paper sheet in the delivery direction; a reversing section 7 that reverses the paper sheet folded into A4 size in the cross-folding section 6; a rotating section 8 that rotates the paper sheet; and a tray 9 that the paper sheet is discharged thereto.

The main body 200 includes an image reader 205 and a manual paper feeding tray 208 arranged under the image reader 205. When a paper sheet is set on the manual paper feeding tray 208, the paper sheet is fed into the main body 200 and paused by a resist roller 207 and then fed into an image forming unit 206 at an appropriate timing.

The image forming unit 206 forms a latent image corresponding to image data on a photoreceptor, the latent image is developed with toner, and the toner is fixed on the paper sheet by a fixing device 210. The paper sheet is then discharged by a paper sheet discharging roll 211 from the copying machine and fed into the paper sheet folding device 1 when the paper sheet is to be folded. When the paper sheet is not to be folded, the paper sheet is fed into the middle part of the main body 200 by an upper paper sheet discharging roller 209 with a switching claw (not shown).

The edge-face folding section 3 folds an edge face of the paper sheet delivered into the paper sheet folding device 1. The paper sheet is further accordion-folded in the delivery direction by the accordion-folding section 4 and delivered to the delivery switching section 5. The accordion-folded paper sheet delivered to the delivery switching section 5 is subjected to skew correction in a direction indicated by arrow A in FIG. 28 and punched if the paper sheet is to be punched, and then delivered to the cross-folding section 6.

The accordion-folded paper sheet delivered to the cross-folding section 6 is further accordion-folded to be in A4 size in a direction perpendicular to the first accordion-folded direction. The paper sheet folded in A4 size is reversed by the reversing section 7 to be face-down and rotated to the left and right by 90 degrees to be aligned in the same direction by the rotating section 8 and then discharged to the tray 9.

Figure 1:
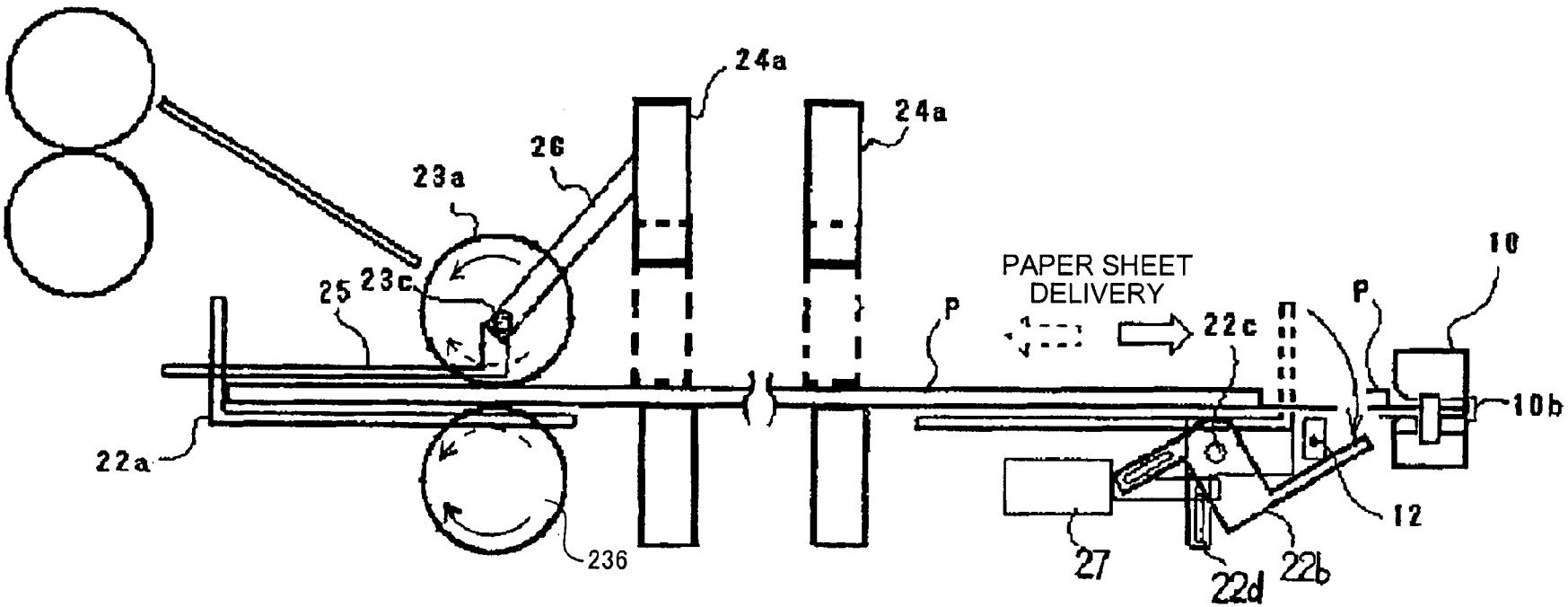
FIG. 1 is a side view of a delivery switching device according to an embodiment of the present invention.
Figure 2:
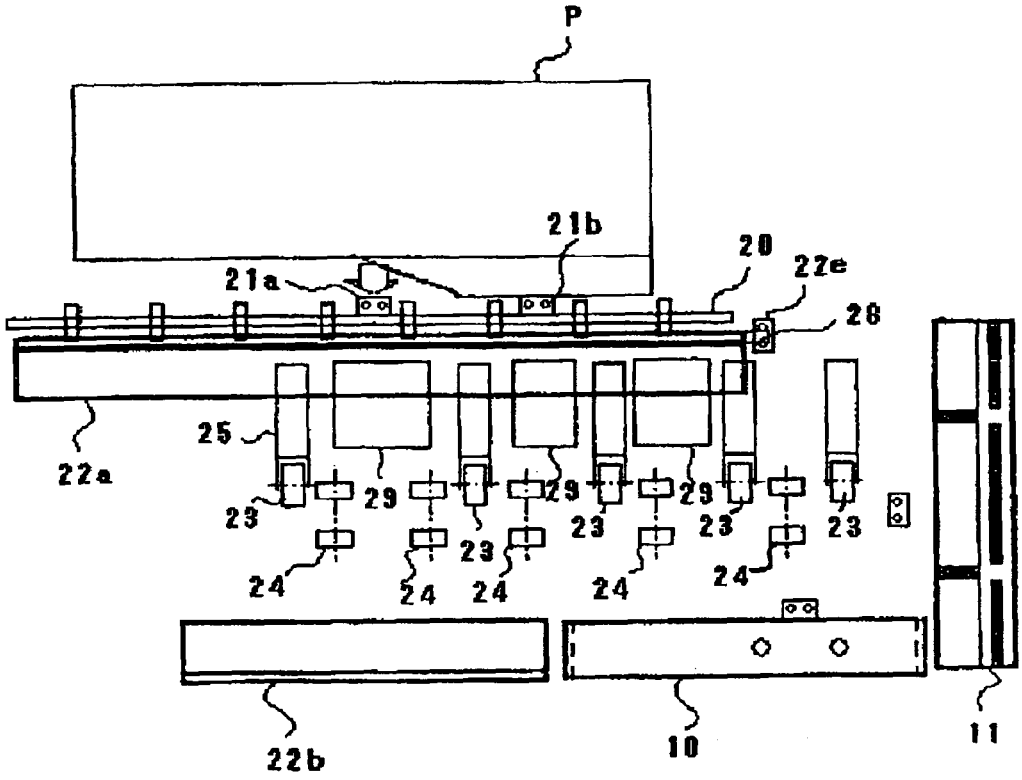
FIG. 2 is a plan view of the delivery switching device shown in FIG. 1.
Figure 3:
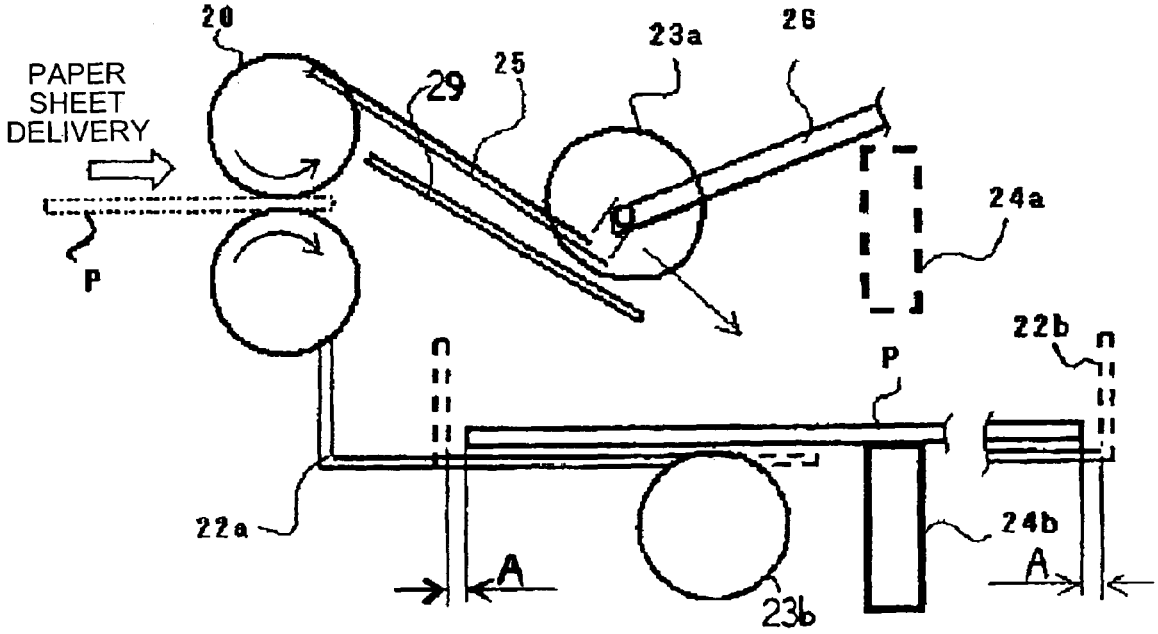
FIG. 3 is an enlarged side view of the delivery switching device shown in FIG. 1.
Figure 4:
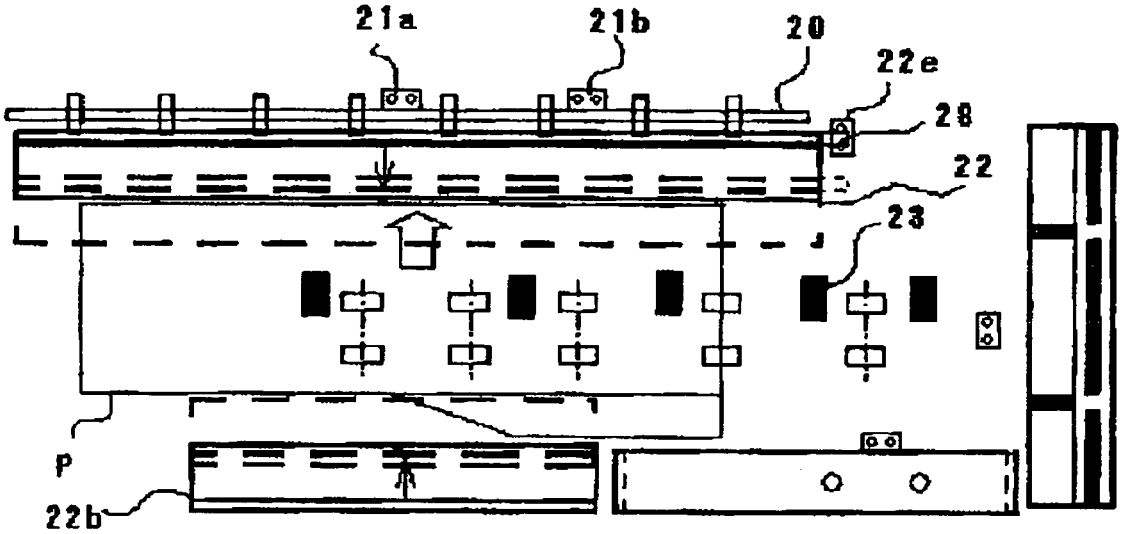
FIG. 4 is a plan view of the delivery switching device for explaining skew correction performed to a portrait A1-sized paper sheet in the switching device.

Mechanism for performing skew correction according to the embodiment is described. FIG. 1 is a side view and FIG. 2 is an plan view of the delivery switching section 5. FIG. 3 is an enlarged side view of the delivery switching section 5. A paper sheet P in FIG. 3 is in the state where the edge face of paper sheet has been folded in the edge-face folding section 3, and the paper sheet is further accordion-folded in the delivery direction in the accordion-folding section 4. Inlet delivery rollers 20 rotate in directions indicated by respective arrows. At one time, the side of the paper sheet contacts a drop guide plate 29 whereby the paper sheet is dropped into a jogger fence 22. As shown in FIG. 3, a jogger fence 22*a* in the upstream side is located under the inlet delivery rollers 20 on standby.

Figure 15:
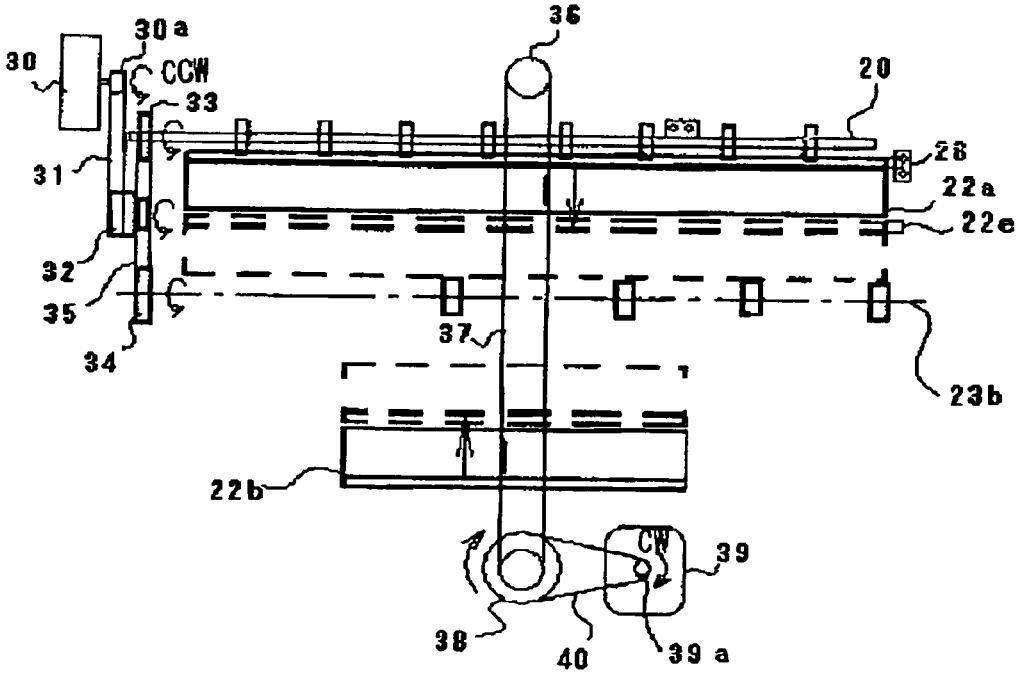
FIG. 15 is a plan view for explaining drive configuration of jogger fences, inlet delivery rollers, and return rollers in the delivery switching device.

As shown in FIG. 15, when a jogger motor 39 rotates clockwise, a drive belt 37 that is coupled to the jogger fence 22*a* and a jogger fence 22*b* rotates in a direction indicated by arrows via a jogger motor pulley 39*a*, a drive belt 40, and a pulley 38, so that the jogger fences 22*a*, 22*b* are closed. When a jogger fence home position light shielding plate 22*e* fixed to the jogger fence 22*a* is in a standby position, the jogger fence home position light shielding plate 22*e* shields a jogger fence home position sensor 28 against the light so that the jogger fence home position sensor 28 turns ON. When the jogger fences 22*a*, 22*b* move, the jogger fence home position sensor 28 turns OFF. The moving distance of jogger fences 22*a*, 22*b* is determined based on the driving time of the jogger motor 39.

As the jogger motor 39 rotates, each of the jogger fences 22*a* and 22*b* moves for the same distance. In other words, the distances between each of the jogger fences 22*a*, 22*b* and the delivery center of the cross-folding section 6 in the downstream side are equal. Furthermore, the distances between the jogger fences 22*a*, 22*b* and the delivery center of the rotation section 8 are equal. Thus, the center line of a paper sheet P is always set on a prespecified position regardless of the size of the paper sheet P.

The jogger fence 22*b* in the downstream side is rotatable around a rotation center 22*c*, and a long hole 22*d* of the jogger fence 22*b* is coupled to a jogger fence oscillating solenoid 27. When the jogger fence oscillating solenoid 27 turns ON, the jogger fence 22*b* rotates around the rotation center 22*c* and escapes from the paper sheet delivery path (See FIG. 1).

Figure 10:
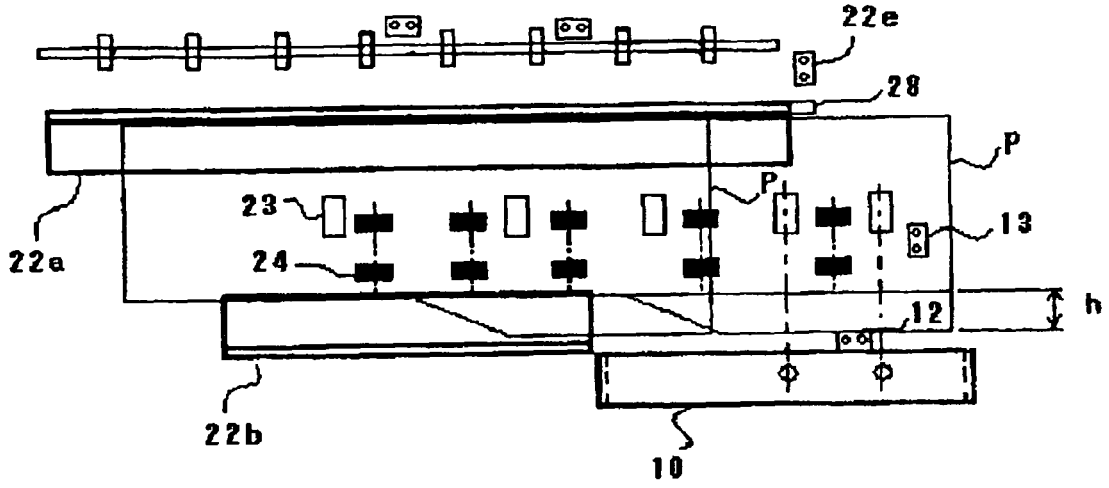
FIG. 10 is a plan view of the delivery switching device in a state before punching a portrait A1-sized paper sheet.
Figure 11:
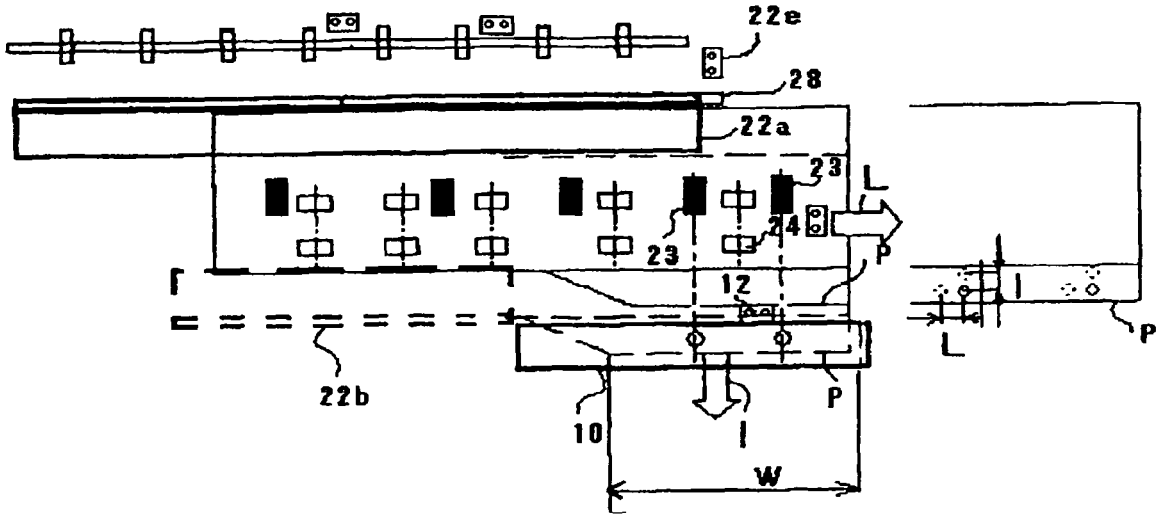
FIG. 11 is a plan view of the delivery switching device in a state while punching the portrait A1-sized paper sheet.
Figure 12:
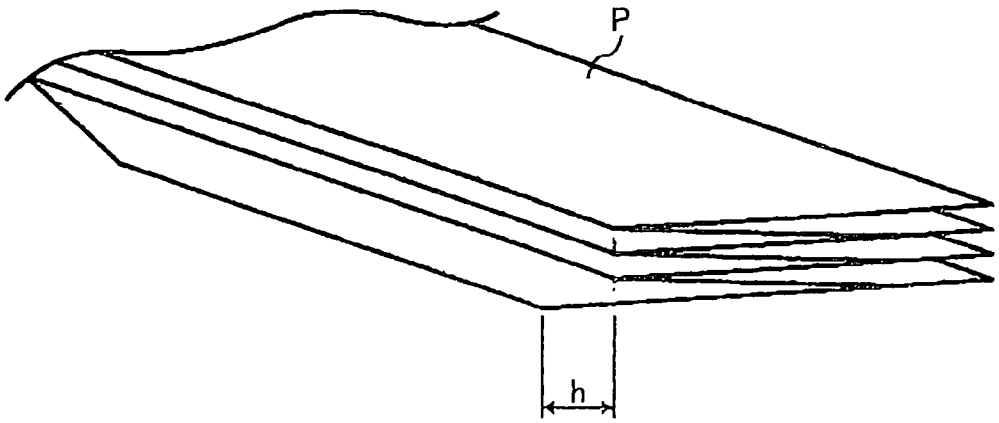
FIG. 12 is a perspective view of a folded portrait A1-sized paper sheet.

The paper sheet delivered to the jogger fences 22*a*, 22*b* can be delivered in a vertical direction I both in the upstream side and in the downstream side by return rollers 23, and in a lateral direction L by a lateral delivery roller 24. A plurality of the return rollers 23 are provided for stable delivery of the paper sheet P even though the type of folding and the size of a paper sheet are different such as an A1-sized paper sheet in FIG. 10 or an A4-sized paper sheet in FIG. 13. As shown in FIG. 11, the return rollers 23 are disposed facing to a punching section (hole positions) in a lateral hole punching unit 10 to prevent skewing of the paper sheet when delivering to the punching section and provide a stable punching.

The return rollers 23 are also disposed adjacent to the jogger fence 22*a* in the upstream side. A pulley 34 secured on the same shaft with drive return rollers 23*b* is connected to a drive belt 35, a pulley 32, a drive belt 31, and a vertical delivery motor pulley 30*a*. When a vertical delivery motor 30 shown in FIG. 15 rotates counterclockwise, the drive return rollers 23*b* also rotate counterclockwise.

When the vertical delivery motor 30 rotates clockwise, the drive return rollers 23*b* also rotate clockwise. As shown in FIG. 15, a pulley 33 secured on the same shaft with the inlet delivery roller 20 is connected to the drive belt 35, the pulley 32, the drive belt 31, and the vertical delivery motor pulley 30*a*. When the vertical delivery motor 30 rotates counterclockwise, the pulley 33 also rotates counterclockwise so that the paper sheet is delivered and dropped into the jogger fence 22.

Figure 5:
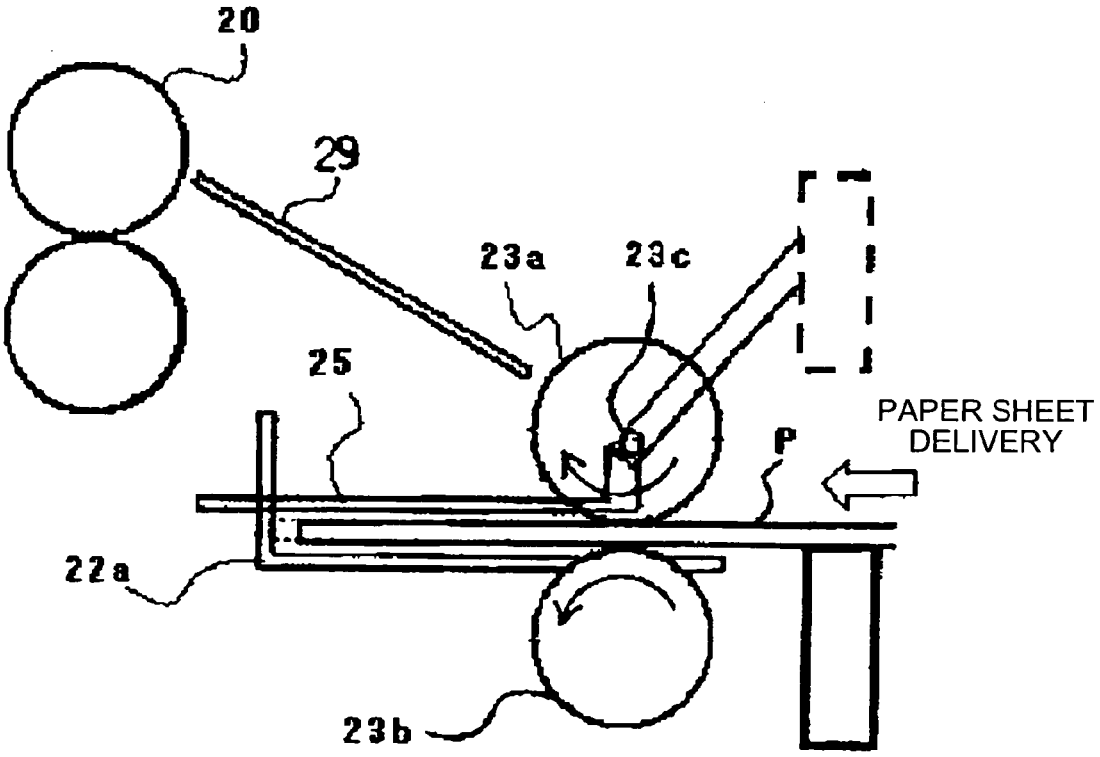
FIG. 5 is a side view of the delivery switching device for explaining the skew correction performed to a portrait A1-sized paper sheet in the switching device.

When the paper sheet P is delivered and dropped in the jogger fence 22 by a pressure driven return roller 23*a* as shown in FIG. 3, the pressure driven return roller 23*a* moves away from the drive return roller 23*b* and sets in a standby position to prevent from contacting the paper sheet. When the vertical delivery motor 30 and the drive return roller 23*b* rotate and deliver the paper sheet as shown in FIG. 5, a solenoid 49 turns ON and pulls a vertical delivery oscillating lever 47, a vertical delivery arm 26 rotates from a position indicated by the dashed-two dotted line to a position indicated by the solid line around a supporting point 26*a* of the vertical delivery arm 26 so that the pressure driven return roller 23*a* attached to the vertical delivery arm 26 via a pressure spring 46 contacts and pressurizes the drive return roller 23*b*.

When the solenoid 49 turns OFF and the vertical delivery oscillating lever 47 is released, the vertical delivery arm 26 rotates from the position indicated by the solid line to the position indicated by the dashed-two dotted line around the supporting point 26*a* of the vertical delivery arm 26 so that the pressure driven return roller 23*a* attached to the vertical delivery arm 26 moves away from the drive return roller 23*b*. As shown in FIG. 2 and FIG. 3, a pressing guide 25 is rotatably attached on the same shaft with a rotation fulcrum shaft 23*c* of the pressure driven return roller 23*a*. As shown FIG. 5, when the pressure driven return roller 23*a* contacts the paper sheet P, the pressing guide 25 presses the top surface of the paper sheet.

Figure 16:
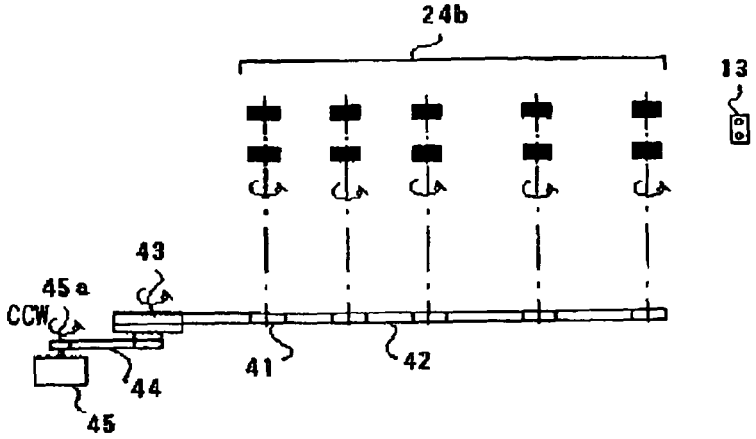
FIG. 16 is a plan view for explaining drive configuration of lateral delivery rollers in the delivery switching device.

The paper sheet delivered to the jogger fences 22*a*, 22*b* may be delivered to the cross-folding section 6 in the downstream side by a lateral delivery roller 24. As shown in FIG. 16, a pulley 41 secured on the same shaft with lateral delivery drive rollers 24*b* is connected to a drive belt 42, a pulley 43, a drive belt 44, and a lateral delivery motor pulley 45*a*. When a lateral delivery motor 45 rotates counterclockwise, the lateral delivery drive rollers 24*b* are driven to rotate counterclockwise so that the paper sheet is delivered to the cross-folding section 6.

Figure 18:
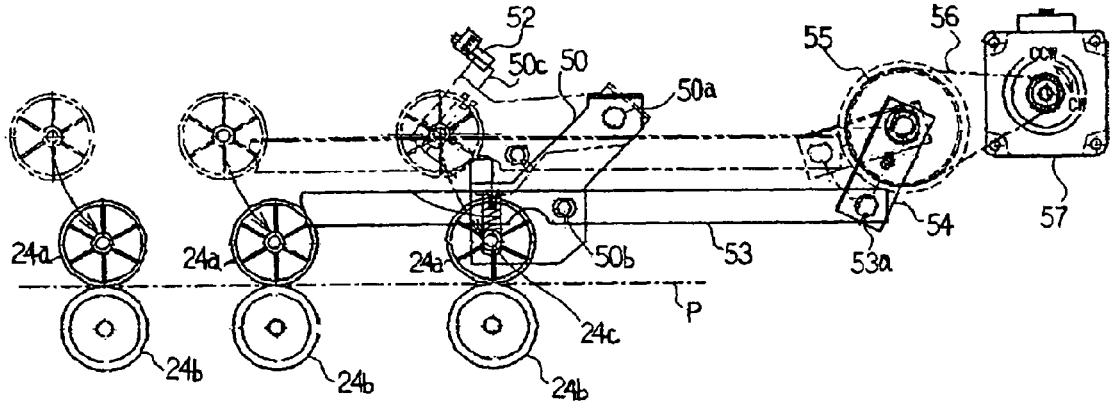
FIG. 18 is a schematic view for explaining a pressure oscillating mechanism of the lateral delivery rollers in the delivery switching device.

A pressure driven lateral delivery roller 24*a* is, as shown in FIG. 18, connected to a lateral delivery oscillating pressure bracket 50 via a shaft 24*c* of the pressure driven lateral delivery roller 24*a* and a spring 51. The lateral delivery oscillating pressure bracket 50 supporting a line of a plurality of the pressure driven lateral delivery rollers 24*a* rotates and oscillates from a position indicated by the dashed-two dotted line that is a standby position to a position indicated by the solid line around a rotation center 50*a*.

The lateral delivery oscillating pressure bracket 50 is rotatably connected to a lateral delivery oscillating pressure arm 53 at a lateral delivery oscillating pressure arm connecting fulcrum 50*b*, and the lateral delivery oscillating pressure arm 53 is rotatably connected to a lateral delivery oscillating lever 54 coupled to a pulley 55 at a lateral delivery oscillating pressure lever connecting fulcrum 53*a*.

As shown in FIG. 18, the pulley 55 is connected to a pulley 57*a* of a lateral delivery oscillating pressure motor 57 via a drive belt 56. When the lateral delivery oscillating pressure motor 57 rotates clockwise, the pressure driven lateral delivery rollers 24*a* move from a position indicated by the solid line where the lateral delivery drive rollers 24*b* contact to a position indicated by the dashed-two dotted line that is a standby position. When the lateral delivery oscillating pressure motor 57 rotates counterclockwise, the pressure driven lateral delivery rollers 24*a* move from a position indicated by the dashed-two dotted line that is a standby position to a position indicated by the solid line where the lateral delivery drive rollers 24*b* contact.

The lateral delivery oscillating pressure arm 53 includes a home position detecting light shielding plate 50*c* and detects a position with a home position sensor 52 at the position indicated by the dashed-two dotted line, namely at the standby position of the pressure driven lateral delivery rollers 24*a*.

Figure 19:
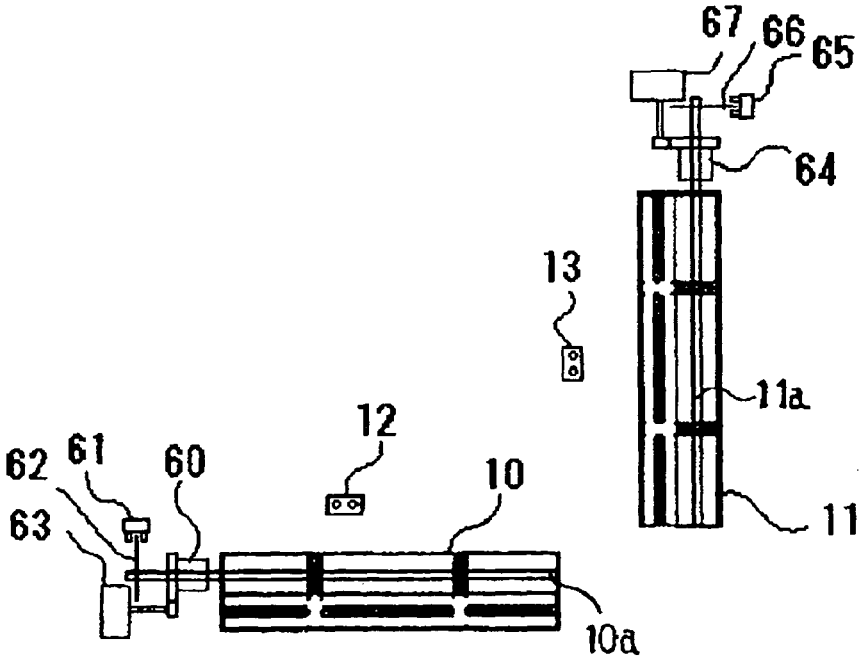
FIG. 19 is a schematic block diagram for explaining a punching mechanism of the delivery switching device.

Configurations of the lateral hole punching unit (punching unit) 10 provided in parallel to the right downstream side of the jogger fence 22*b* and the vertical hole punching unit (punching unit) 11 perpendicular to the lateral delivery direction are described below. The lateral hole punching unit 10 includes, as shown in FIG. 19, a clutch for lateral hole punching 60 on the same shaft with a drive shaft 10*a* of the lateral hole punching unit that punches by moving up and down, and holds a home position light shielding plate for lateral hole punching 62 on the same shaft.

The clutch for lateral hole punching 60 is connected to a motor for lateral hole punching 63, and the home position light shielding plate for lateral hole punching 62 shields a home position sensor for lateral hole punching 61 against the light at the standby position and then the home position sensor for lateral hole punching 61 turns ON. When the motor for lateral hole punching 63 starts rotating, the clutch for lateral hole punching 60 turns ON and the drive shaft 10*a* of the lateral hole punching unit rotates, so that the lateral hole punching unit 10 starts punching by moving up and down. The drive shaft 10*a* of the lateral hole punching unit rotates by 360 degrees, the home position light shielding plate for lateral hole punching 62 shields the home position sensor for lateral hole punching 61 against the light, the home position sensor for lateral hole punching 61 turns ON, the clutch for lateral hole punching 60 turns OFF, and then the home position light shielding plate for lateral hole punching 62 stops at the standby position.

A paper sheet tip detecting sensor for lateral hole punching 12 is disposed adjacent to the entrance of lateral hole punching unit 10 and detects a timing to stop delivering a paper sheet to the lateral hole punching unit 10. The vertical hole punching unit 11 includes a clutch for vertical hole punching 64 on the same shaft with a drive shaft 11*a* of the vertical hole punching unit that punches by moving up and down, and holds a home position light shielding plate for vertical hole punching 66 on the same shaft.

The clutch for vertical hole punching 64 is connected to a motor for vertical hole punching 67, and the home position light shielding plate for vertical hole punching 66 shields a home position sensor for vertical hole punching 65 against the light at the standby position and then the home position sensor for vertical hole punching 65 turns ON. When the motor for vertical hole punching 67 starts rotating, the clutch for vertical hole punching 64 turns ON and the drive shaft 11*a* of the vertical hole punching unit rotates, so that the vertical hole punching unit 11 starts punching by moving up and down. The drive shaft 11*a* of the vertical hole punching unit rotates by 360 degrees, the home position light shielding plate for vertical hole punching 66 shields the home position sensor for vertical hole punching 65 against the light, the home position sensor for vertical hole punching 65 turns ON, the clutch for vertical hole punching 64 turns OFF, and then the home position light shielding plate for vertical hole punching 66 stops at the standby position.

A paper sheet tip detecting sensor for vertical hole punching 13 is disposed adjacent to the entrance of vertical hole punching unit 11 and detects a timing to stop delivering a paper sheet to the vertical hole punching unit 11.

Figure 9:
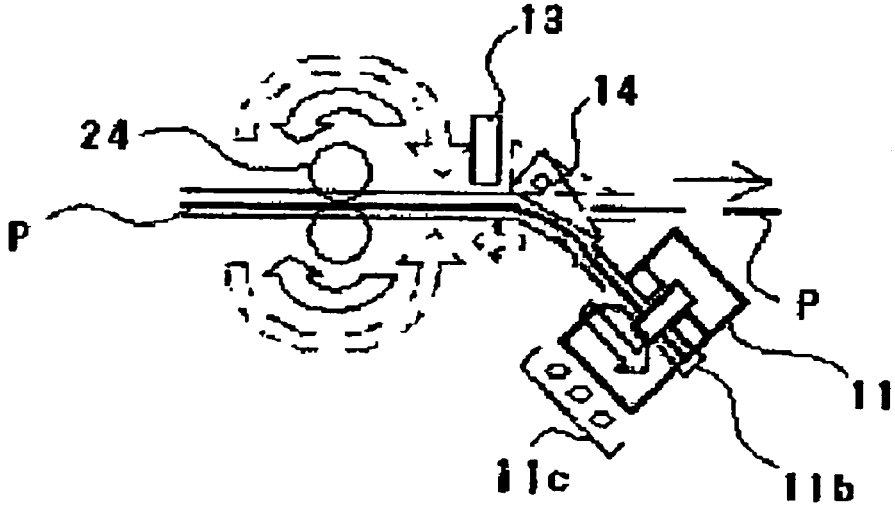
FIG. 9 is an enlarged side view of a punching device shown in FIG. 2.

As shown in FIG. 9, the vertical hole punching unit 11 is inclined. It is easy to collect paper chips or paper dust produced during the punching that drops into a vertical hole punching chip tray 11*c*.

When a main body controlling substrate 202 receives input signals such as the type of folding and the size of paper sheet from an operating section 201 of the main body, information is transmitted to a cross controlling substrate and then a paper sheet is delivered and punched by controlling each motor based on the information transmitted from each sensor.

Functions and advantages of the paper sheet folding device are described below. With reference to FIGS. 2 to 7, there is described the operation of skew correction to the paper sheet P that is folded its edge face in the edge-face folding section 3 and further accordion-folded in the delivery direction in the accordion-folding section 4.

Figure 20:
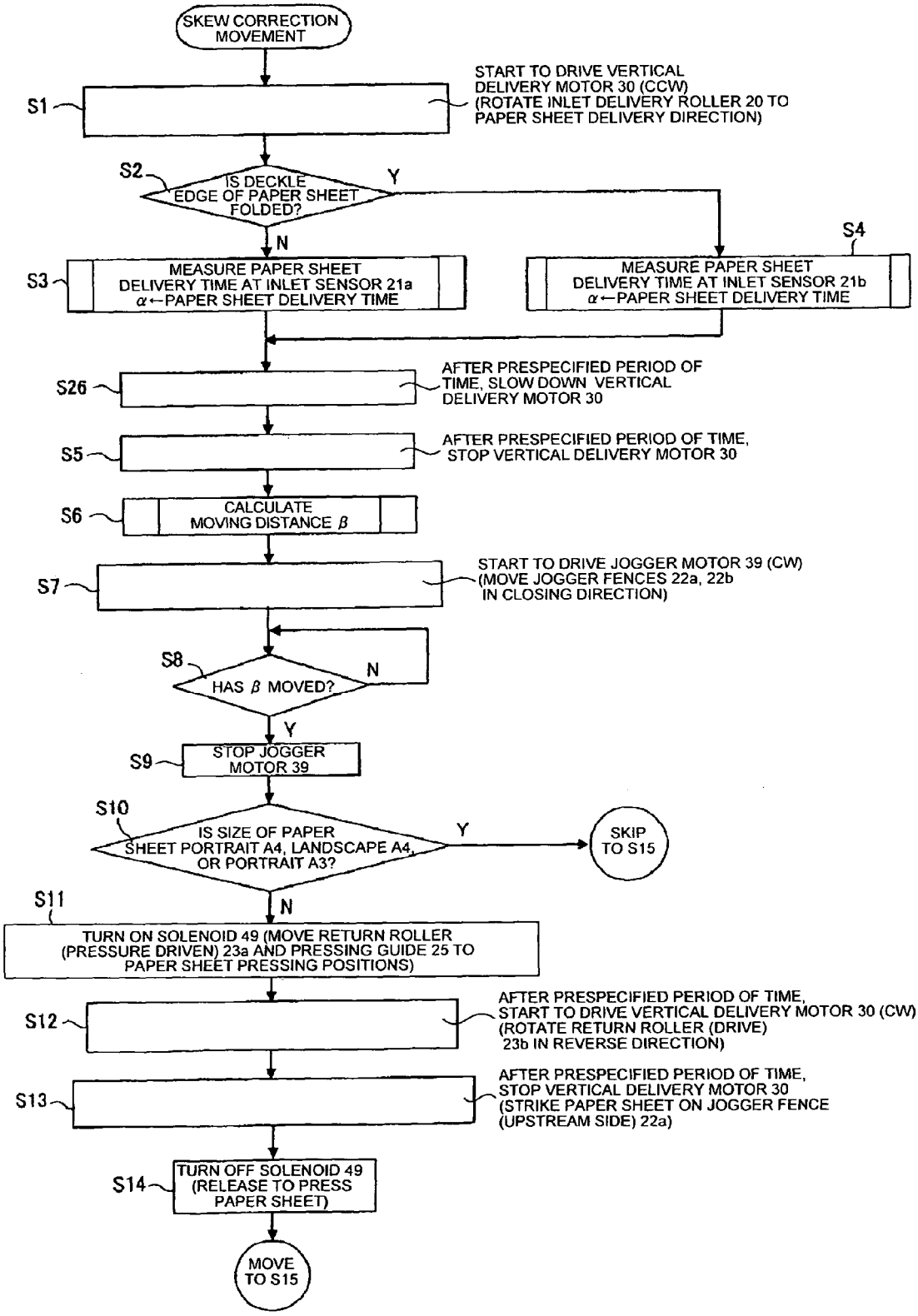
FIG. 20 is a flowchart for explaining skew correction to a paper sheet according to the present embodiments.

As shown in the flowchart of FIG. 20, when the vertical delivery motor 30 in FIG. 15 rotates counterclockwise, a paper sheet is delivered into the inlet delivery roller 20 and further delivered along a guide plate 29 in FIG. 3, and then dropped into the jogger fence 22 (step S1).

Figure 22A:
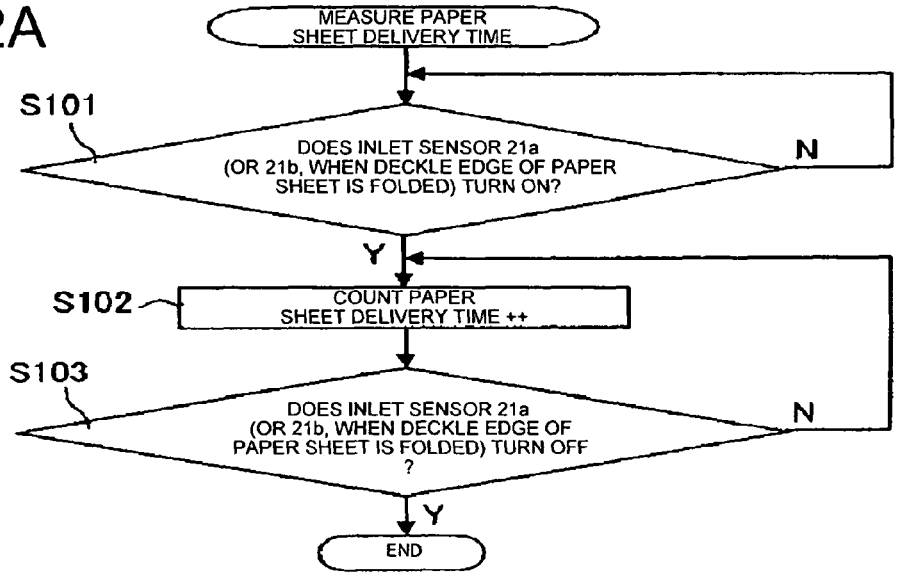
FIG. 22A is a flowchart for explaining measurement of the delivery time of a paper sheet.

For detecting the delivery time of the paper sheet P, the paper sheet P is detected whether a deckle edge of the paper sheet is folded (step S2). When the deckle edge of the paper sheet is folded, a flow for measuring the delivery time of the paper sheet is executed as shown in a flowchart of FIG. 22A (steps S3 and S4). When the deckle edge of the paper sheet is folded, an inlet sensor for deckle edge folding 21*b* detects a tip of the paper sheet. When the deckle edge of the paper sheet is not folded, an inlet sensor for deckle edge folding 21*a* detects a tip of the paper sheet.

For measuring the delivery time of the paper sheet, when the inlet sensor for deckle edge 21*a* or the inlet sensor for deckle edge 21*b* turns ON after the paper sheet P is delivered from the accordion-folding section 4 (step S101), the delivery time of the paper sheet a is counted by a delivery switching punch controller 100 (step S102), and then the inlet sensor 21*a* or the inlet sensor 21*b* turns OFF (step S103) and the measurement of the delivery time of the paper sheet is completed.

Figure 23A:
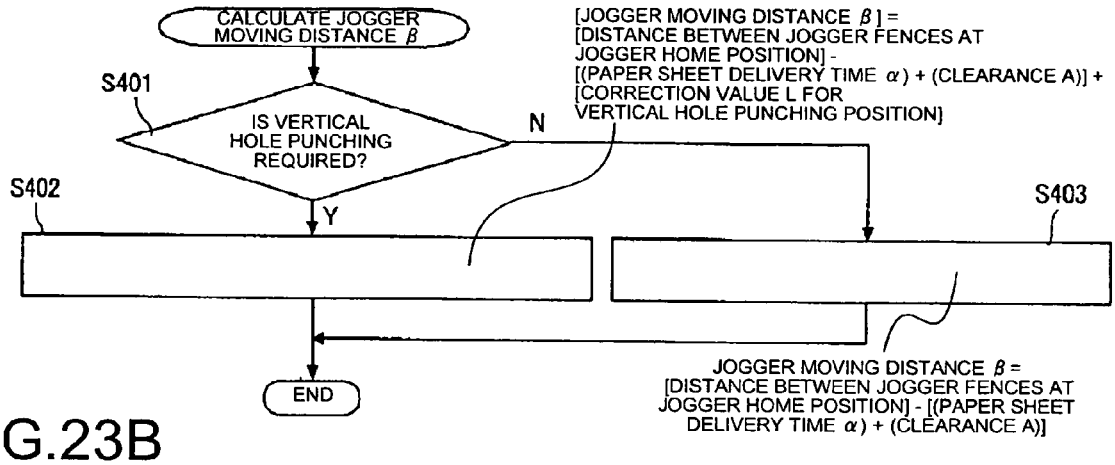
FIG. 23A is a flowchart for explaining calculation of the moving distance of a jogger.

The paper sheet P is delivered in a direction indicated by an arrow and dropped into the jogger fence 22, and after a prespecified period of time, the vertical delivery motor 30 stops (step S5). The delivery switching punch controller 100 calculates moving distance of the jogger fence β. The moving distance of the jogger fence B is calculated on expressions shown in steps S402 (*2) and S403 (*1) as shown in a flowchart of FIG. 23A.

(*1): [Distance between the jogger fences at the jogger home positions] minus [[delivery time of the paper sheet a] plus [clearance A]]

(*2): [Distance between the jogger fences at the jogger home positions] minus [[delivery time of the paper sheet a] plus [clearance A]] plus [correction value L for the vertical hole punching position]

Clearances A in FIG. 3 are clearances between a paper sheet and the jogger fence 22*a* in the upstream side, the jogger fence 22*b* in the downstream side respectively. In the present example, when a paper sheet is delivered along the guide plate 29 and dropped into the jogger fence 22, the paper sheet is dropped in a position close to the jogger fence 22*a* in the upstream side based on the angle and the height of the guide plate 29, and the discharging velocity of the paper sheet P from the inlet delivery rollers 20. The clearance A between the paper sheet and the jogger fence 22*a* in the upstream side in FIG. 3 is set to zero.

When the jogger motor 39 in FIG. 15 rotates clockwise (step S8), the jogger fence 22 is moved by the moving distance of the jogger fence β calculated in S6 and the jogger motor 39 stops with leaving the clearance A as shown in FIG. 3 (step S9).

When the paper sheet P is not folded in the cross-folding section 6 in the downstream side, in the example, when the paper sheet P in FIG. 2 is a portrait A4-sized paper sheet, a landscape A4-sized paper sheet, or a portrait A3-sized paper sheet, the flow action skips to the lateral delivery movement (step S15). When the paper sheet P is folded in the cross-folding section 6, skew correction such that the paper sheet is struck to the jogger fence 22*a* by the drive return rollers 23*a*, 23*b* in FIG. 5 is executed.

In the following step S10, the paper sheet P is checked to determine whether the paper sheet P is a portrait A4-sized paper sheet, a landscape A4-sized paper sheet, or a portrait A3-sized paper sheet. When the paper sheet P is not any of a portrait A4-sized paper sheet, a landscape A4-sized paper sheet, and a portrait A3-sized paper sheet, the solenoid 49 in FIG. 17 turns ON. When the solenoid 49 turns ON and pulls the vertical delivery oscillating lever 47, the vertical delivery arm 26 rotates from a position indicated by the dashed-two dotted line to a position indicated by the solid line around the supporting point 26*a* of the vertical delivery arm 26, and the pressure driven return roller 23*a* attached to the vertical delivery arm 26 via the pressure spring 46 contacts and pressurizes the drive return roller 23*b* (step S11).

The state is shown in FIG. 5. The pressing guide 25 rotatably attached on the same shaft with the rotation fulcrum shaft 23*c* of the pressure driven return roller 23*a* presses the top surface of the paper sheet. After a prespecified period of time, when the vertical delivery motor 30 in FIG. 15 rotates clockwise, the paper sheet P is delivered to the jogger fence 22*a* in the upstream side by the drive return roller 23*b* in FIG. 5 (step S12).

Figure 6:
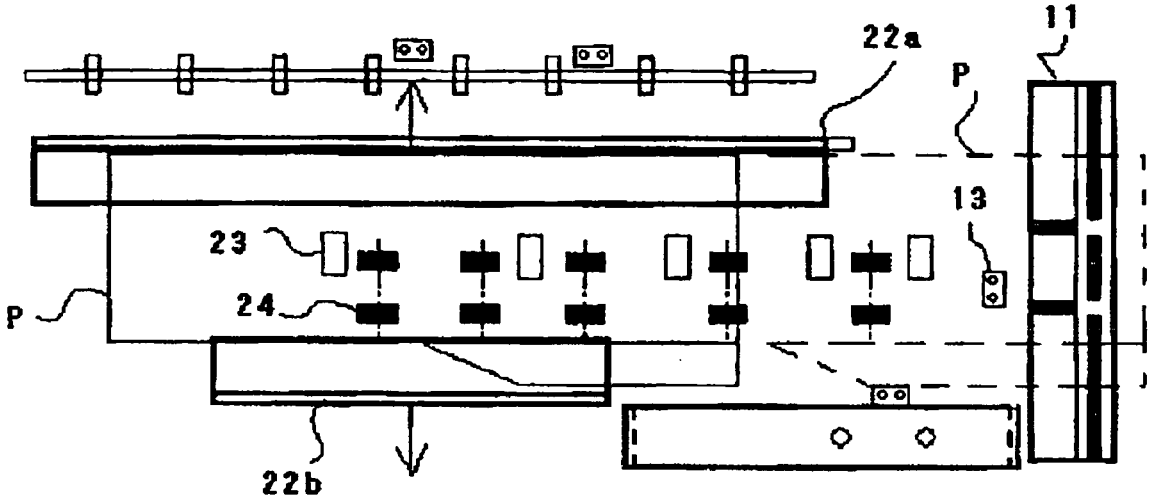
FIG. 6 is a plan view of the delivery switching device for explaining the skew correction performed to a portrait A1-sized paper sheet in the switching device.
Figure 7:
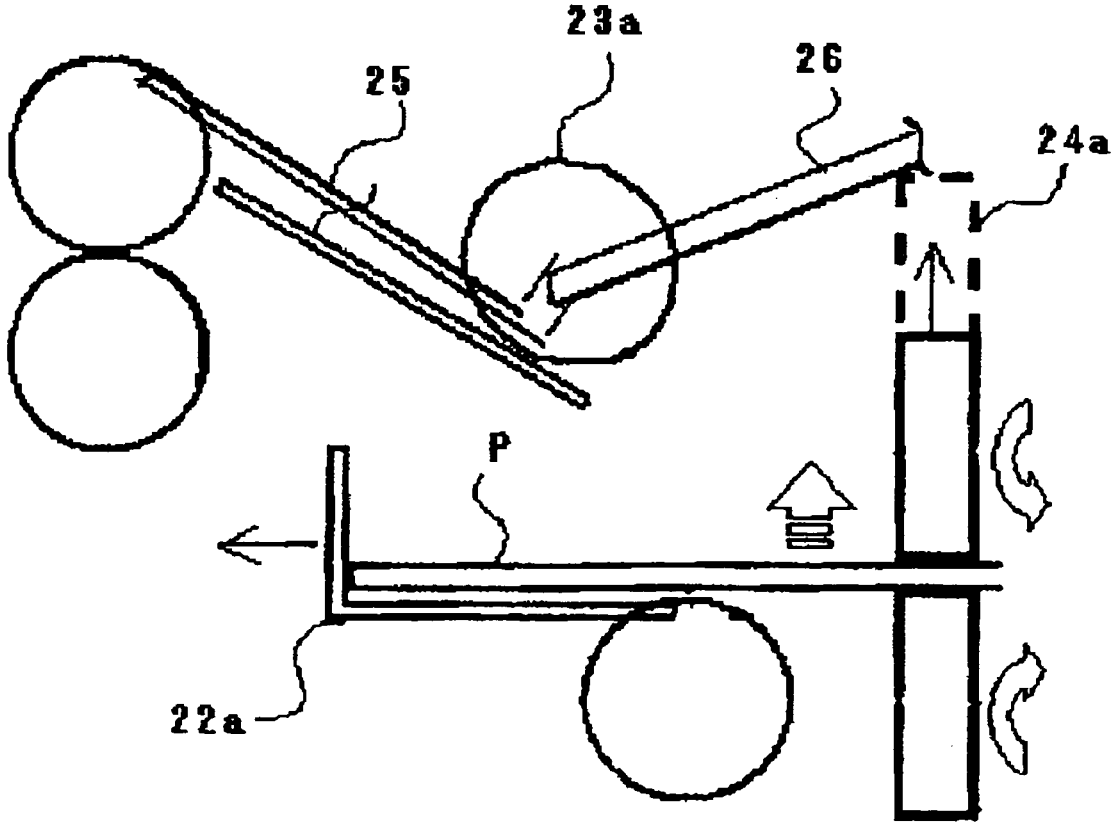
FIG. 7 is a side view of the delivery switching device for explaining the skew correction performed to a portrait A1-sized paper sheet in the switching device.
Figure 17:
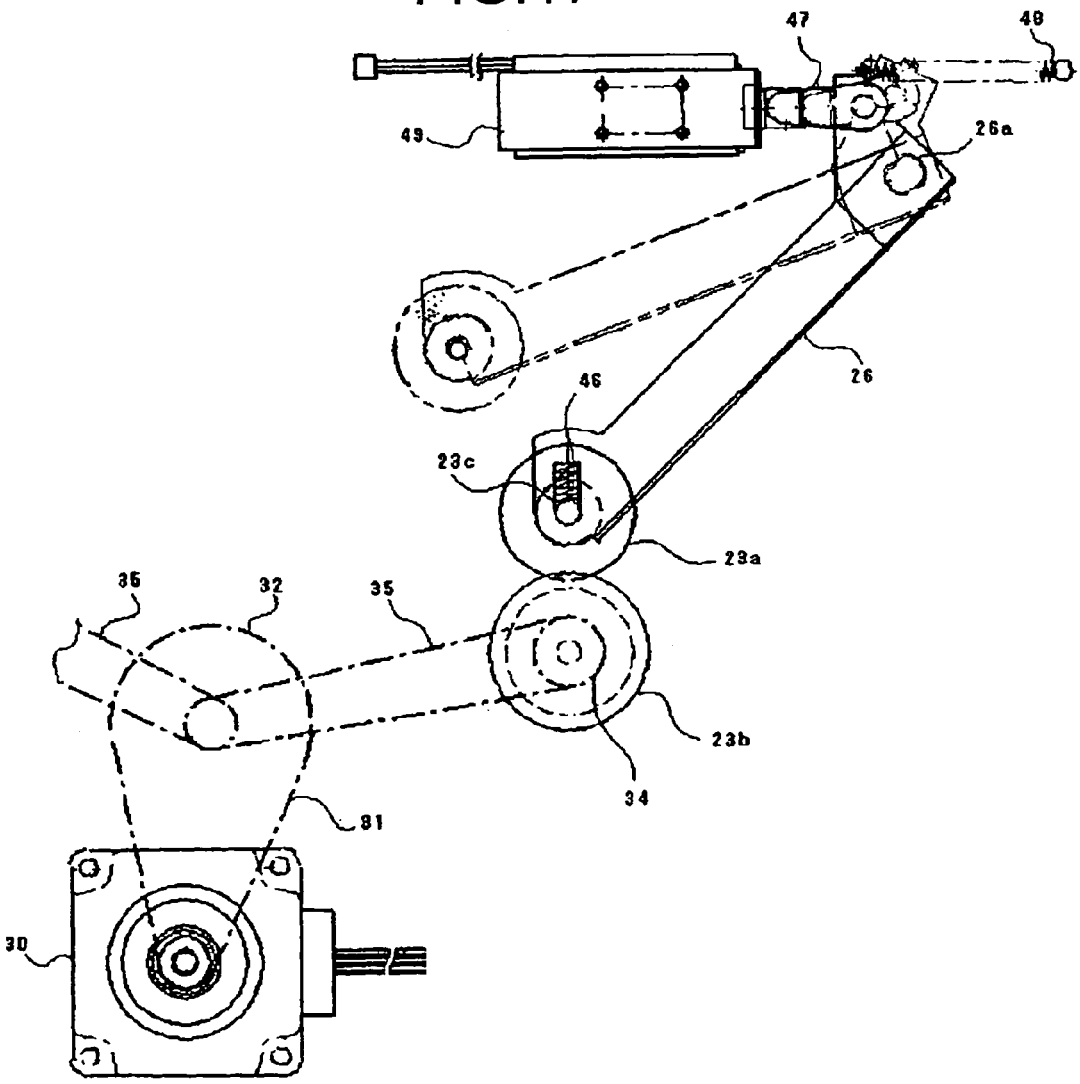
FIG. 17 is a schematic view for explaining an oscillating mechanism of a return roller in the delivery switching device.

As shown in FIG. 6, when the paper sheet P is delivered from a position indicated by the solid line to a position indicated by the dashed line where the paper sheet P contacts the jogger fence 22*a* in the upstream side, after a prespecified period of time, the vertical delivery motor 30 stops (step S13). When the solenoid 49 turns OFF, as shown in FIG. 17, the pressure driven return roller 23*a* moves away from the drive return roller 23*b* and rotates from a position indicated by the solid line to a position indicated by the dashed-two dotted line that is the standby position (step S14).

When the lateral delivery oscillating pressure motor 57 in FIG. 18 rotates counterclockwise, the pressure driven lateral delivery rollers 24*a* move from a position indicated by dashed-two dotted line that is the standby position to a position indicated by the solid line that contact to the lateral delivery drive rollers 24*b* (step S15).

Figure 13:
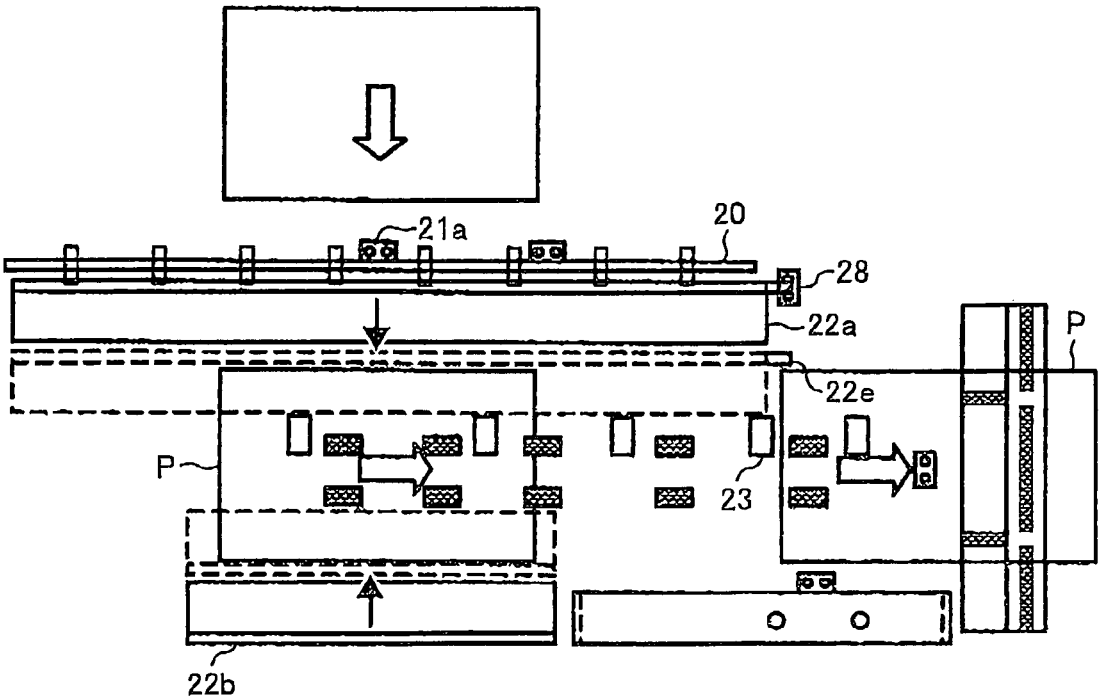
FIG. 13 is a plan view of the delivery switching device for explaining skew correction performed to a landscape A4-sized paper sheet.
Figure 14:
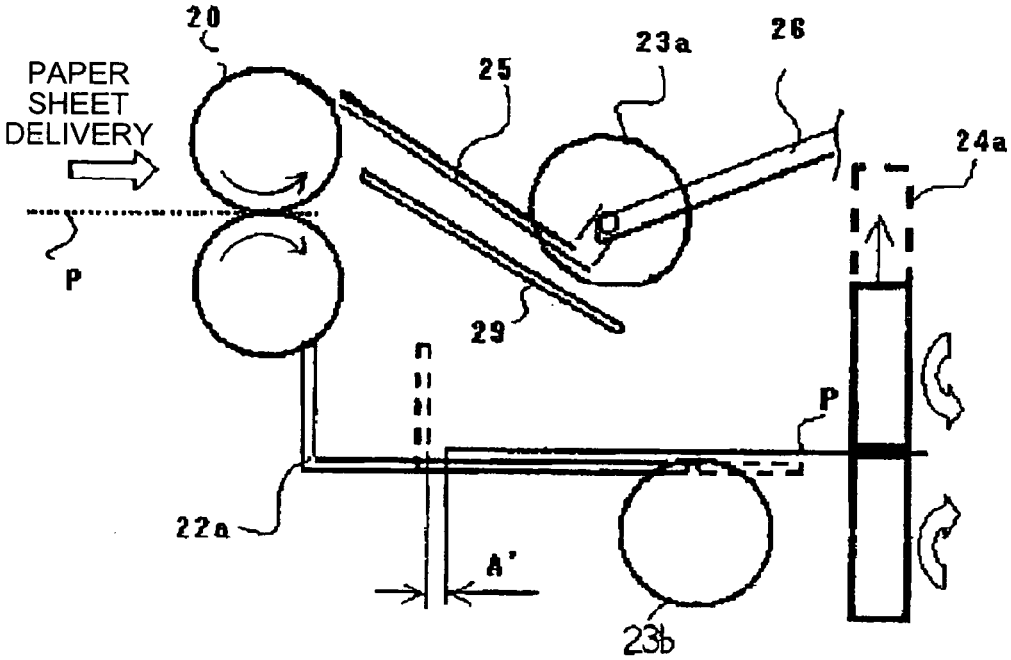
FIG. 14 is a side view of the delivery switching device for explaining skew correction performed to a landscape A4-sized paper sheet.

After a prespecified period of time, when the pressure driven lateral delivery rollers 24*a* press and sandwich the paper sheet P with the lateral delivery drive rollers 24*b*, the lateral delivery oscillating pressure motor 57 stops (step S16). When the lateral delivery motor 45 rotates counterclockwise as shown in FIG. 16, the lateral delivery drive rollers 24*b* are driven to rotate in a direction indicated by arrows. The pressure driven lateral delivery rollers 24*a* press and sandwich the paper sheet P with the lateral delivery drive rollers 24*b*, and the lateral delivery drive rollers 24*b* rotate in directions indicated by arrows and deliver the paper sheet P in a lateral direction towards the cross-folding section 6 as shown in FIG. 13 (step S17).

The paper sheet P is checked to determine whether the paper sheet is to be punched (step S18). When the paper sheet P is to be punched, checking is performed to determine whether the required punching is the vertical hole punching or the lateral hole punching (step S19). When the vertical hole punching process is made on the paper sheet P, a paper sheet moving process for vertical hole punching position is executed (step S20). When the lateral hole punching process is made on the paper sheet P, a paper sheet moving process for lateral hole punching position is executed (step S21).

When the punching process is not made on the paper sheet P or after the paper sheet moving process for vertical hole punching position (step S20), the paper sheet P is delivered in a lateral direction to the cross-folding section 6. As shown in a position indicated by the dashed line in FIG. 6, a tip of the paper sheet P passes through the paper sheet tip detecting sensor for vertical hole punching 13 (step S22), and then a rear end of the paper sheet P passes through the paper sheet tip detecting sensor for vertical hole punching 13 (step S23). After the rear end of the paper sheet P passes through the paper sheet tip detecting sensor for vertical hole punching 13, the lateral delivery motor 45 stops (step S24). Then a jogger fence home position moving process (See FIG. 22B) and a lateral delivery oscillating pressure home position moving process (See FIG. 22C) are executed, and then the processing flow is completed.

Figure 22B:
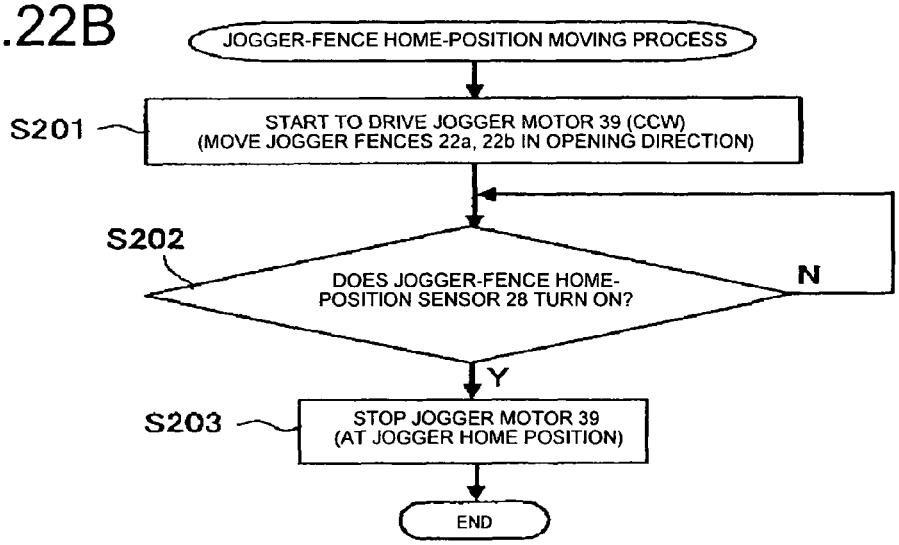
FIG. 22B is a flowchart for explaining the movement of a jogger fence home position.

A flowchart in FIG. 22B is described. The jogger fence home position moving process is a process that the jogger fence 22 is returned back to the standby position, namely, to a position where the jogger fence home position light shielding plate 22*e* shields the jogger fence home position sensor 28 against the light and the jogger fence home position sensor 28 turns ON. When the jogger motor 39 rotates counterclockwise as shown in FIG. 15 (step S201), the jogger fences 22*a*, 22*b* move in the open direction, and the jogger fence home position light shielding plate 22*e* shields the jogger fence home position sensor 28 against the light and the jogger fence home position sensor 28 turns ON (step S202). When the jogger fence home position sensor 28 turns ON, the jogger motor 39 stops (step S203), and then the jogger fence home position moving process is completed.

Figure 22C:
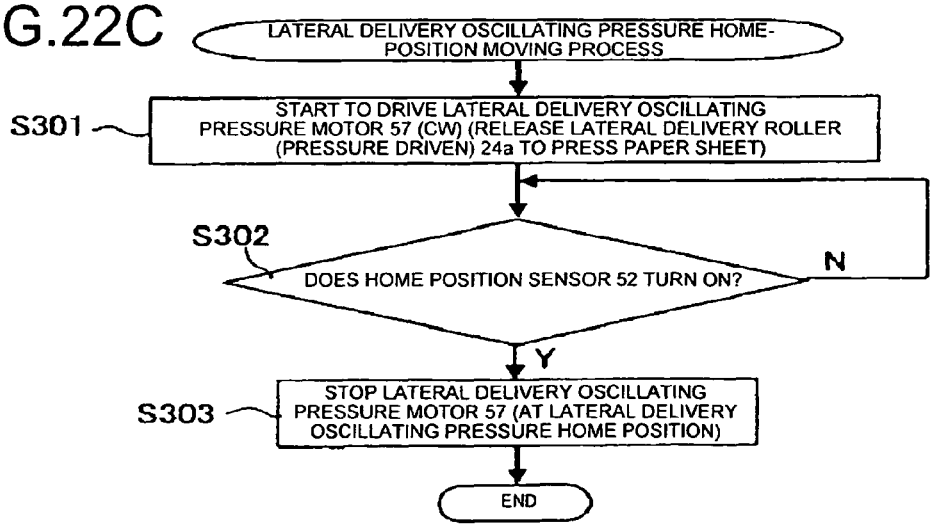
FIG. 22C is a flowchart for explaining the movement of a lateral delivery oscillating pressure home position.

A flowchart for the lateral delivery oscillating pressure home position moving process in FIG. 22C is described. As shown in FIG. 18, when the lateral delivery oscillating pressure motor 57 rotates clockwise (step S301), the pressure driven lateral delivery rollers 24*a* move away from a position indicated by the solid line that contact to the lateral delivery drive rollers 24*b* to a position indicated by the dashed-two dotted line that is the standby position (step S301). The home position detecting light shielding plate 50*c* for the lateral delivery oscillating pressure arm 53 makes the home position sensor 52 turn ON (step S302), and the home position sensor 52 detects a standby position. When the standby position is detected, the lateral delivery oscillating pressure motor 57 stops (step S303), and then the lateral delivery oscillating pressure home position moving process is completed.

Figure 8:
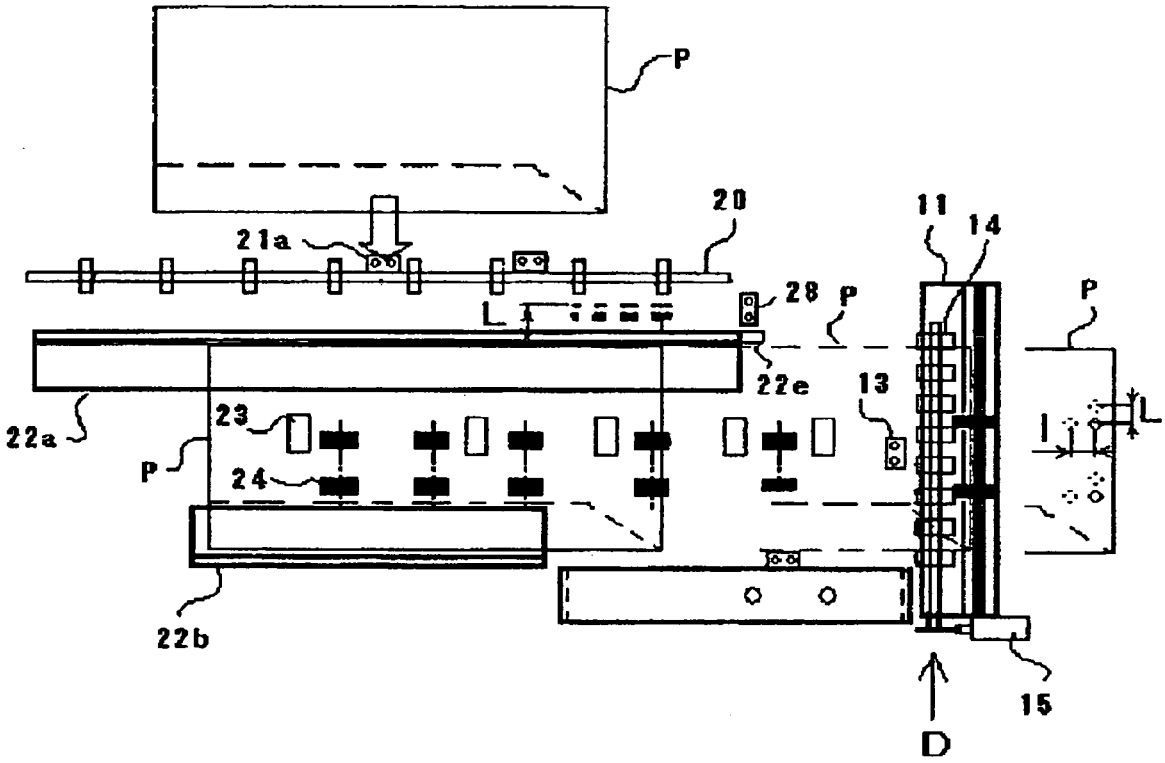
FIG. 8 is a plan view of the delivery switching device for explaining punching of a landscape A2-sized paper sheet.
Figure 21:
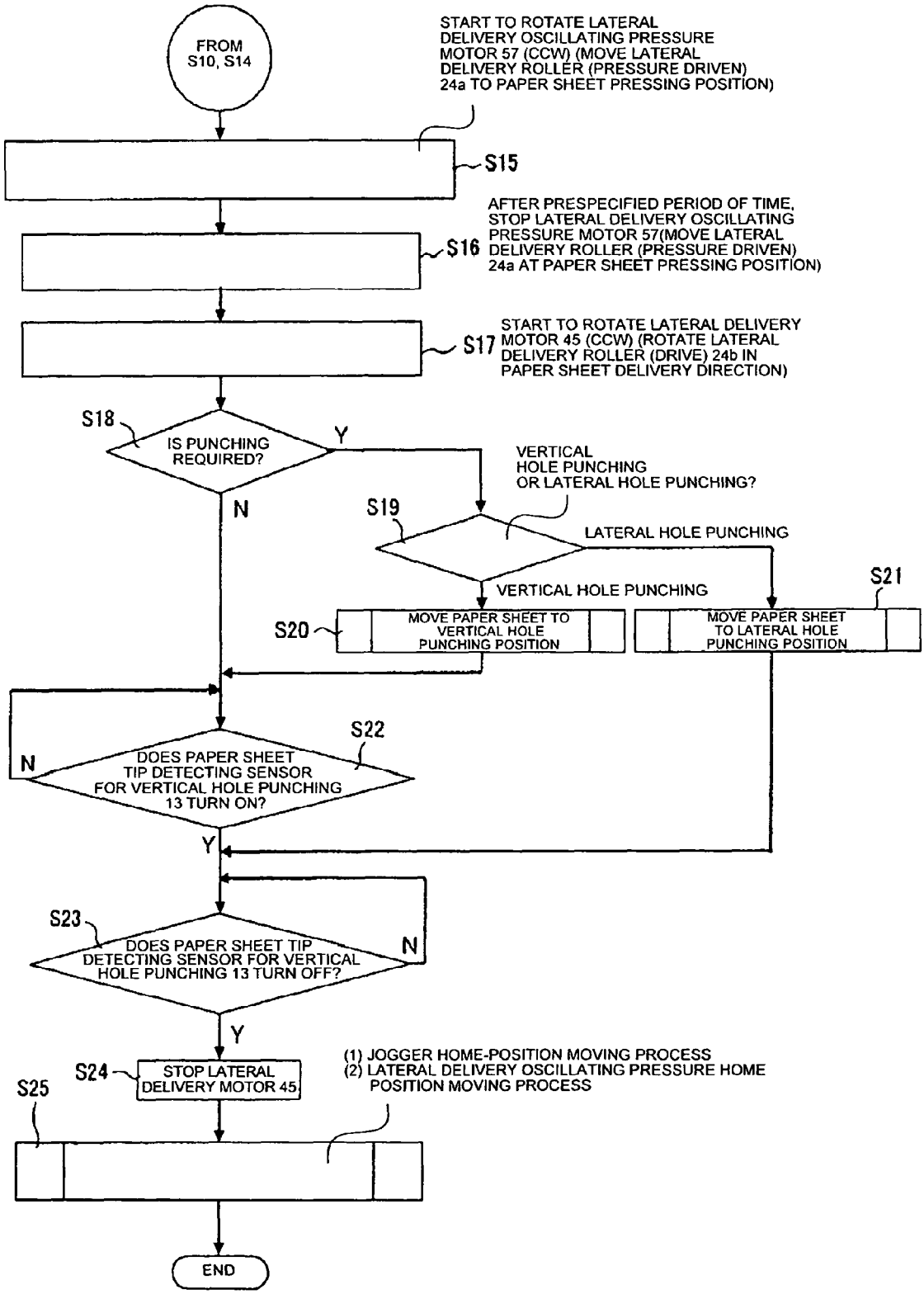
FIG. 21 is a continuation of the flowchart shown in FIG. 20.
Figure 23B:
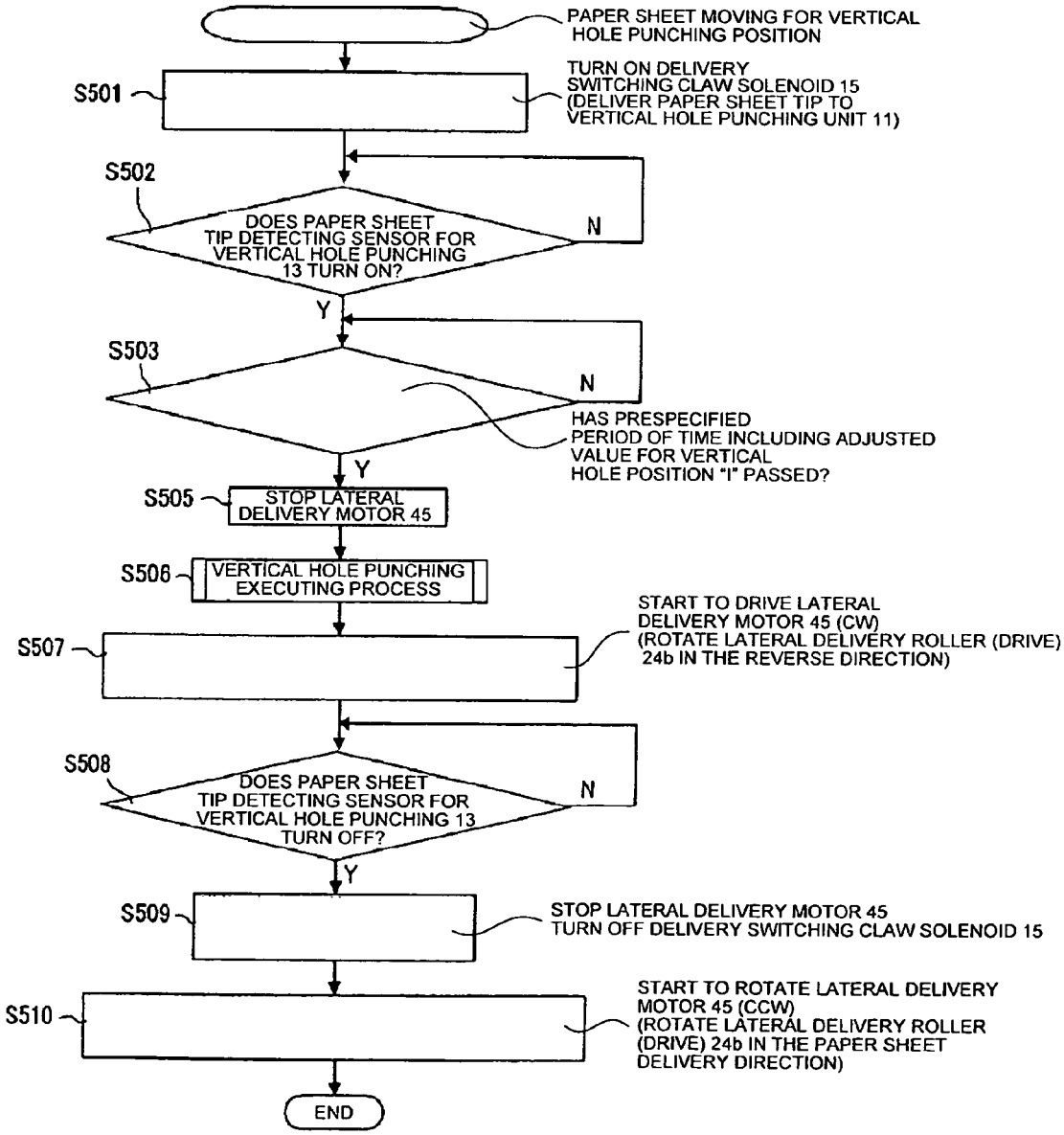
FIG. 23B is a flowchart for explaining movement of a paper sheet to a lateral hole punching position.

A flowchart for the paper sheet moving process for vertical hole punching position (step S20) in FIG. 21 is described with reference to a flowchart in FIG. 23B. When a delivery switching claw solenoid 15 in FIG. 8 turns ON, a punch delivery switching claw 14 in FIG. 9 moves from a position indicated by the dashed lied to a position indicated by the solid line, and the paper sheet delivery path is turned into the vertical hole punching unit 11 (step S501). As shown in FIG. 8, when a tip of the paper sheet P passes through the paper sheet tip detecting sensor for vertical hole punching 13, the paper sheet tip detecting sensor for vertical hole punching 13 detects an ON signal (step S502), and the lateral delivery motor 45 in FIG. 16 stops (step S505) in a prespecified period of time (step S503). The prespecified period of time for stopping the lateral delivery motor 45 is the total of a period of time for delivering the paper sheet P to a prespecified position to be punched and a period of time for adjusting the vertical hole position as shown in FIG. 8. When the correction value L for the vertical hole punching position is zero, a tip of the paper sheet contacts to a vertical hole punching struck surface 11*b*.

When the lateral delivery motor 45 stops, a vertical hole punching executing process is made (step S506). When the lateral delivery motor 45 rotates clockwise, the lateral delivery drive rollers 24*b* are driven to rotate in the reverse direction and switchback the delivery direction of the paper sheet P indicated by dashed line arrows in FIG. 9 (step S507). When a tip of the paper sheet P passes through the paper sheet tip detecting sensor for vertical hole punching 13 (step S508), the lateral delivery motor 45 stops and the delivery switching claw solenoid 15 in FIG. 8 turns OFF, and then the switchback delivery is stopped (step S509).

When the lateral delivery motor 45 rotates counterclockwise once again as shown in FIG. 16, the lateral delivery drive rollers 24*b* are driven to rotate counterclockwise, and the pressure driven lateral delivery rollers 24*a* press and sandwich the paper sheet P with the lateral delivery drive rollers 24*b*. The pressure driven lateral delivery rollers 24*a* and the lateral delivery drive rollers 24*b* rotate in the directions indicated by arrows as shown in FIG. 16, and the paper sheet P is delivered in a lateral direction to the cross-folding section 6 (step S510), and then the paper sheet moving process for vertical hole punching position is completed.

A flowchart for the paper sheet moving process for lateral hole punching position (step S21) in FIG. 21 is described with reference to a flowchart in FIG. 24. As shown in FIG. 10, when the paper sheet P is delivered in a lateral direction and a tip of the paper sheet P passes through the paper sheet tip detecting sensor for vertical hole punching 13, the paper sheet tip detecting sensor for vertical hole punching 13 detects an ON signal (step S602) and the lateral delivery motor 45 stops in a prespecified period of time (step S603). The prespecified period of time in this case is the total of a period of time for delivering the paper sheet P to a prespecified position to be punched and a period of time for adjusting the lateral hole position as shown FIG. 11.

For switching from the lateral delivery to the vertical delivery of the paper sheet, a paper sheet moving process for lateral delivery oscillating pressure home position is executed (step S604). When the jogger fence oscillating solenoid 27 turns ON, the jogger fence 22*b* rotates around the rotation center 22*c* and moves from a position indicated by the dashed line that is in of the paper sheet delivery path to a position indicated by the solid line as shown in FIG. 1 (step S605). When the solenoid 49 in FIG. 17 turns ON, the vertical delivery arm 26 rotates and moves from a position indicated by the dashed-two dotted line to a position indicated by the solid line, and the pressure driven return roller 23*a* contacts to the drive return roller 23*b*. The state is as shown in FIG. 1 (step S606).

After a prespecified period of time, when the vertical delivery motor 30 rotates counterclockwise, the drive return roller 23*b* in FIG. 1 rotates in a direction of an arrow indicated by the solid line, and the paper sheet P is delivered in a direction of an arrow indicated by the solid line (step S607). When a tip of the paper sheet P passes through the paper sheet tip detecting sensor for lateral hole punching 12 (step S608), the vertical delivery motor 30 stops after a prespecified period of time (step S609).

The prespecified period of time in this case is the total of a period of time for delivering the paper sheet P to a prespecified position to be punched and a period of time for adjusting the lateral hole position as shown FIG. 11. When the correction value L for the lateral hole punching position is zero, a tip of the paper sheet contacts to a lateral hole punching struck surface 10*b*.

The lateral hole punching unit 10 has an opening with enough width to insert a paper sheet therein such that the width of the opening is equal to or more than the width of binding margin W of the paper sheet P, as shown in FIG. 11. The return rollers 23 are disposed in a position facing to a punching position of the lateral hole punching unit 10 as shown in FIG. 11. In this state, the lateral hole punching executing process is executed and then lateral hole punching is done (step S610).

When the vertical delivery motor 30 in FIG. 15 rotates clockwise, the drive return roller 23*b* in FIG. 1 rotates in a direction indicated by a dashed line arrow so that the delivery direction is switchback and the paper sheet P is delivered in a direction indicated by a dashed line arrow towards the jogger fence 22*a* in the upstream side (step S611). After a prespecified period of time, the paper sheet P is struck to the jogger fence 22*a* in the upstream side and the vertical delivery motor 30 stops (step S612).

When the solenoid 49 in FIG. 17 turns OFF, the pressure driven return roller 23*a* moves away from the drive return roller 23*b*, and the vertical delivery arm 26 rotates and returns back from a position indicated by the solid line to a position indicated by the dashed-two dotted line that is the standby position (step S613). When the jogger fence oscillating solenoid 27 in FIG. 1 turns OFF, the jogger fence 22*b* rotates around the rotation center 22*c* and moves from a position indicated by the solid line that guides the paper sheet P to a position indicated by the dashed line (step S614).

When the lateral delivery oscillating pressure motor 57 rotates counterclockwise as shown in FIG. 18, the pressure driven lateral delivery rollers 24*a* move from a position indicated by the dashed-two dotted line that is the standby position to a position indicated by the solid line that contact with the lateral delivery drive rollers 24*b* (step S615). After a prespecified period of time, the pressure driven lateral delivery rollers 24*a* move to a position indicated by the dashed line with sandwiching the paper sheet P with the lateral delivery drive rollers 24*b*, and the lateral delivery oscillating pressure motor 57 stops (step S616).

When the lateral delivery motor 45 rotates counterclockwise once again, the paper sheet P in FIG. 11 is delivered towards the cross-folding section 6 (a direction indicated by an arrow) (step S617). After a tip of the paper sheet P is confirmed to be on the paper sheet tip detecting sensor for vertical hole punching 13 (step S618), a rear end of the paper sheet P passes through the paper sheet tip detecting sensor for vertical hole punching 13 (step S619). After the rear end of the paper sheet P passes through the paper sheet tip detecting sensor for vertical hole punching 13, the lateral delivery motor 45 stops (step S620), and the jogger fence home position moving process and the lateral delivery oscillating pressure home position moving process are executed (step S621), and then the flows are completed.

Figure 25:
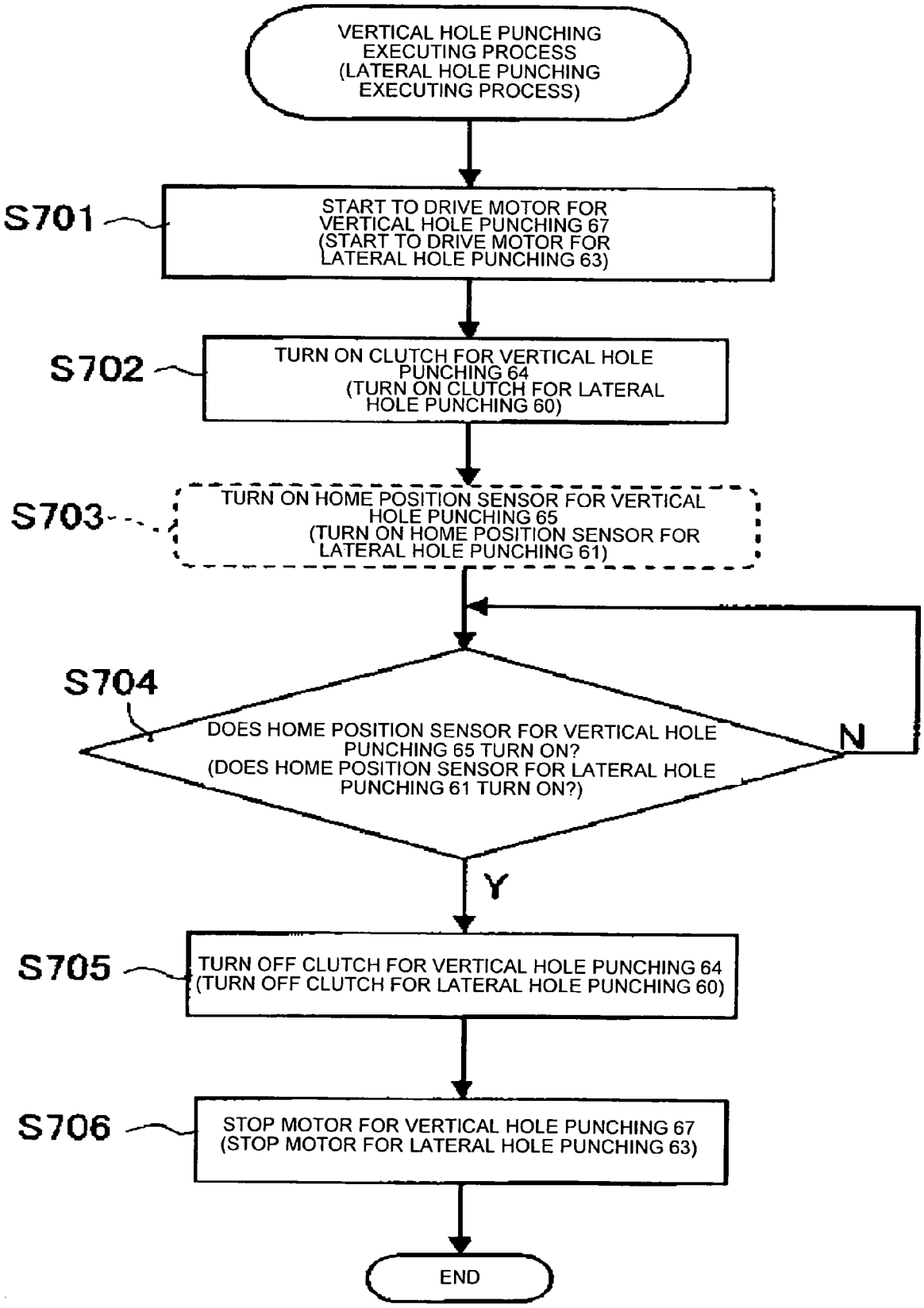
FIG. 25 is a flowchart for explaining a working process of lateral hole punching.
Figure 26:
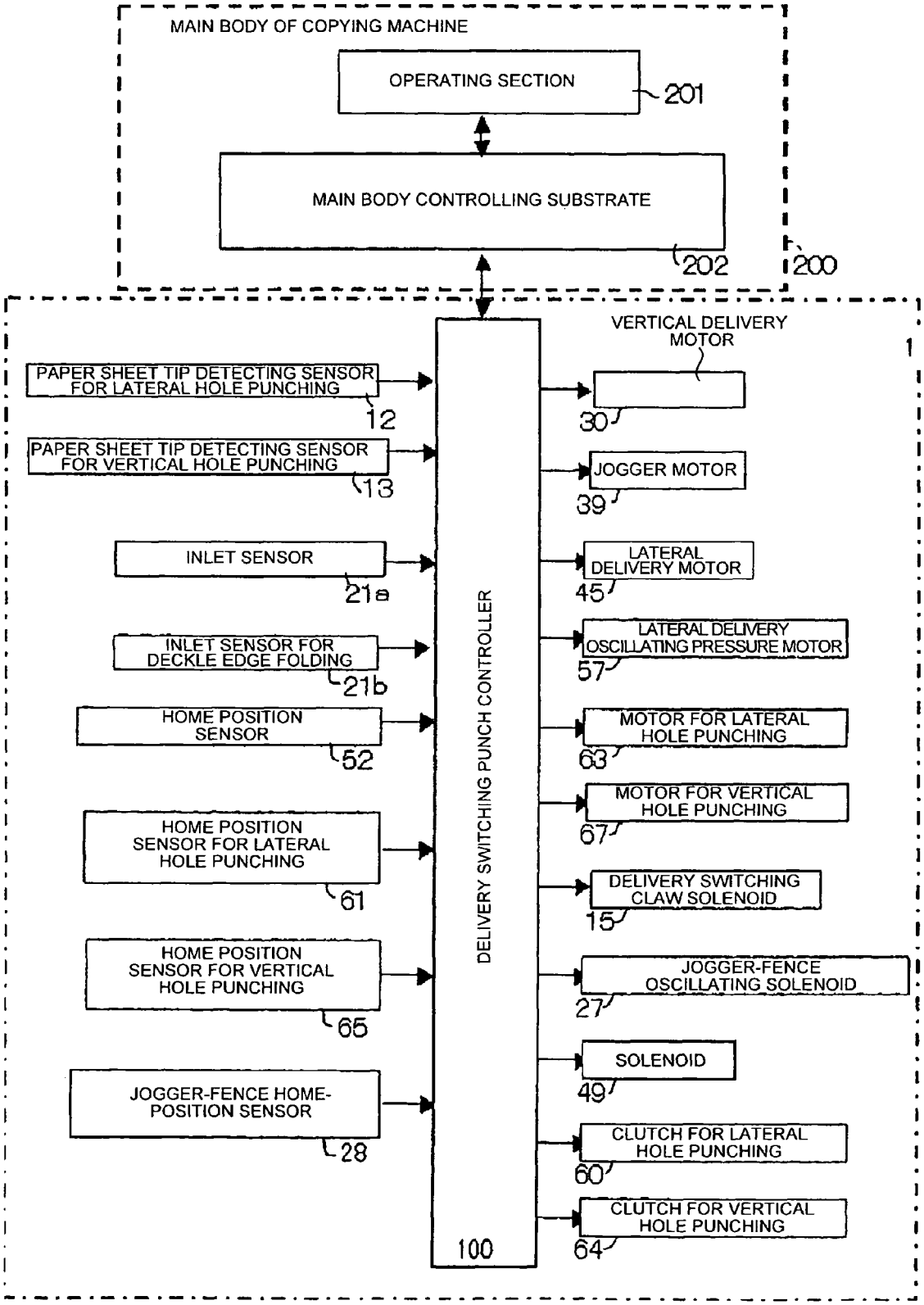
FIG. 26 is a block diagram of the paper sheet folding device according to the embodiments.

The vertical/lateral hole punching executing processes in S506, S610 are described with reference to a flowchart in FIG. 25. The vertical hole punching unit 11 and the lateral hole punching unit 10 have basically same configuration so that only the vertical hole punching unit 11 is described. When the motor for vertical hole punching 67 in FIG. 19 rotates in a prespecified direction (step S701), the clutch for vertical hole punching 64 turns ON (step S702). At the same moment, the home position sensor for vertical hole punching 65 is confirmed to be ON-state that is a standby-state.

After the home position sensor for vertical hole punching 65 is confirmed to be ON-state that is the standby-state, the rotation drive of the motor for vertical hole punching 67 is transmitted via the clutch for vertical hole punching 64 to the drive shaft 11*a* of vertical hole punching, and a mechanism of the punching (not shown) executes punching. In this state, the home position sensor for vertical hole punching 65 is switched OFF. After the punching, the home position sensor for vertical hole punching 65 is switched ON to be the standby-state again (step S704). At this moment, the clutch for vertical hole punching 64 turns OFF (step S705), and the motor for vertical hole punching 67 stops in a prespecified period of time, and then the flow of the paper sheet moving process for vertical hole punching is completed. The flow of the paper sheet moving process for lateral hole punching is same as the flow of the paper sheet moving process for vertical hole punching.

According to the present invention, after binding holes are formed on the delivered paper sheet at prespecified positions, the paper sheet with binding holes formed thereon is switchback in the reverse direction, so that the paper sheet need not pass through the lateral hole punching unit 10 and the vertical hole punching unit 11. Thus, it is unnecessary to provide a wide clearance between the punch and the die in the punching unit so that it may avoid the problem in punching due to the irregular clearances.

Before binding holes are formed on the paper sheet, skew correction to the paper sheet is executed. Thus, the paper sheet is inserted straightforward into the punching units 10, 11 so that it may improve the punching accuracy. Skew correction to the folded paper sheet before punched thereon is done by the jogger fence 20, namely skew correction only for punching is not required. Thus, it may reduce costs.

The punching units 10, 11 include a punching struck surface in the downstream side of the delivery direction respectively so that a distance between a tip of the paper sheet and the punching position is maintained constant. Thus, it may minimize the irregularity of punching positions.

The vertical hole punching unit 11 is inclined against the delivery direction so that a punching chip drops into a punching chip tray with its own weight. It is unnecessary to provide a mechanism for collecting a punching chip in the vertical hole punching unit 11, so that it may reduce costs.

The width of the lateral hole punching unit 10 for paper sheet entry is larger than the width of binding margin so that the binding margin of the paper sheet is hardly stuck in the entrance of the lateral hole punching unit 10. Thus, it may avoid the paper jam.

The present invention is not limited to the embodiments described above and various changes may be made without departing from the scope of the invention. According to the embodiments described above, the vertical hole punching unit 11 is inclined against the delivery direction. Alternatively, the lateral hole punching unit 10 may be inclined against the delivery direction.

According to an aspect of the present invention, after binding holes are formed at prespecified positions on a paper sheet, the paper sheet is switchback in the reverse direction, so that the paper sheet need not pass through a punching unit. Thus, it is not necessary to provide a wide clearance between a punch and a die in the punching unit, so that irregular punching does not occur.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A paper-sheet punching device for punching a hole in a paper sheet, the paper sheet punching device comprising:

a sheet receiving unit that receives a paper sheet from a preliminary device;

a jogger fence that performs a skew correction on the paper sheet;

a plurality of first rollers that delivers the paper sheet;

a plurality of second rollers that is rotatable in a normal direction and in a reverse direction and conveys the paper sheet in a direction perpendicular to a direction in which the paper sheet is delivered by the plurality of first rollers;

a first punching unit that punches a hole in an edge portion of the paper sheet;

a second punching unit that punches a hole in another edge portion perpendicular to the edge portion of the paper sheet is provided; and a control unit that performs the skew correction by striking the paper sheet received by the plurality of first rollers onto the jogger fence, delivers the skew-corrected paper sheet towards the first punching unit by rotating the plurality of second rollers in the normal direction, punches the hole in the edge portion of the skew-corrected paper sheet, and switchbacks the punched paper sheet towards an opposite direction to the first punching unit by rotating the plurality of second rollers in the reverse direction according to a punching mode, wherein:

the plurality of first rollers is configured to be rotatable in a normal direction and a reverse direction, and the control unit performs the skew correction by striking the paper sheet received by rotating the plurality of first rollers in the normal direction onto the jogger fence, delivers the skew corrected paper sheet by using the plurality of second rollers, delivers the skew corrected paper sheet toward the second punching unit located in an opposite direction to the jogger fence by rotating the plurality of first rollers in the reverse direction at a predetermined position, includes a second punch mode in which the second punching unit punches the hole in the perpendicular edge portion of the paper sheet.

2. The paper-sheet punching device according to claim 1, wherein the preliminary device includes an accordion-folding section that accordion-folds the paper sheet, the control unit performs the skew correction by striking an accordion-folded portion that is not binding allowance of the accordion-folded paper sheet by rotating the plurality of first rollers in the normal direction in the second punch mode, and the second punching unit punches a hole in the accordion-folded portion of the paper sheet.

* * * * *